US008977167B2

(12) United States Patent
Seki et al.

(10) Patent No.: US 8,977,167 B2
(45) Date of Patent: Mar. 10, 2015

(54) IMAGE FORMING APPARATUS

(75) Inventors: Tatsuru Seki, Tachikawa (JP); Hisatoshi Baba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 201 days.

(21) Appl. No.: 13/449,653

(22) Filed: Apr. 18, 2012

(65) Prior Publication Data

US 2012/0268793 A1 Oct. 25, 2012

(30) Foreign Application Priority Data

Apr. 20, 2011 (JP) ..... 2011-093903

(51) Int. Cl.
*G03G 15/00* (2006.01)
*G03G 15/01* (2006.01)
*G03G 15/16* (2006.01)

(52) U.S. Cl.
CPC ..... *G03G 15/0131* (2013.01); *G03G 15/1615* (2013.01); *G03G 15/5033* (2013.01)
USPC ..... 399/208; 399/396; 399/16

(58) Field of Classification Search
CPC combination set(s) only.
See application file for complete search history.

(56) References Cited

U.S. PATENT DOCUMENTS 4,409,852 A * 10/1983 Suzuki et al. ..... 73/862.392
7,827,914 B2 * 11/2010 Fernandez et al. ..... 101/485
2006/0133861 A1 * 6/2006 Sakai ..... 399/301
2009/0034992 A1 * 2/2009 Yamaguchi et al. ..... 399/16
2009/0234498 A1 * 9/2009 Takahashi et al. ..... 700/230
2009/0324262 A1 * 12/2009 Matsuda et al. ..... 399/36
2011/0206398 A1 * 8/2011 Isoda et al. ..... 399/49

FOREIGN PATENT DOCUMENTS

JP 2006-160512 A 6/2006
JP 2008-276064 A 11/2008

* cited by examiner

*Primary Examiner* — Tammy Pham
*Assistant Examiner* — Keara Harris
(74) *Attorney, Agent, or Firm* — Fitzpatrick, Cella, Harper & Scinto

(57) ABSTRACT

An image forming apparatus includes a rotatable image bearing member provided with a mark; a driving portion for rotationally driving the image bearing member; a first detecting portion for detecting speed information of the image bearing member by detecting the mark moved in a predetermined first distance; a second detecting portion for detecting speed information of the image bearing member by detecting the mark moved in a second distance shorter than the predetermined first distance; a filter circuit for suppressing a high-frequency part of an output from the detecting portion and a low-frequency part of an output from the second detecting portion; a calculating portion for calculating a speed of the image bearing member detected from an output from the filter circuit; and a controller for controlling the driving portion so that the calculated speed of the image bearing member is a set speed.

2 Claims, 14 Drawing Sheets

IMAGE FORMING APPARATUS

FIELD OF THE INVENTION AND RELATED ART

The present invention relates to an image forming apparatus in which a mark formed on an image bearing member is detected to rotational speed control of the image bearing member. Specifically, the present invention relates to a control method capable of realizing stable control with high gain with respect to a wide frequency component of a speed fluctuation without being influenced by an accuracy of the mark.

The image forming apparatus in which a toner image carried on the image bearing member (photosensitive member or intermediary transfer member) is transferred onto a recording material and then the image is fixed on a recording material surface by heating and pressing the recording material has been widely used. When the speed fluctuation occurs, the speed fluctuation leads to image density non-uniformity due to sparse/dense of scanning lines and a lowering in accuracy of superposition of respective color images and therefore various proposals as to control of a driving motor for the image bearing member have been made.

In Japanese Laid-Open Patent Application (JP-A) 2006-160512, control such that scale-like equidistant marks are formed at edge portions of an intermediary transfer belt and are optically detected to obtain a speed of the intermediary transfer belt in real time and then the real-time speed is fed back to a rotational speed of a driving motor for the intermediary transfer belt is disclosed. However, in this case, a single sensor successively detects the plurality of marks as the same mark and therefore a degree of control of accuracy cannot be enhanced to the extent that the accuracy is not less than mark accuracy. When the intermediary transfer belt is partly elongated to increase a mark interval or a part of the marks is contaminated, a mark detection error occurs and a new speed fluctuation is added to the speed fluctuation of the intermediary transfer belt.

On the other hand, in JP-A 2008-276064, control such that the real-time speed of the intermediary transfer belt is obtained by measuring a time when the same mark passes through two sensors spaced with a distance with respect to a rotational direction of the intermediary transfer belt, and then the real-time speed is fed back to the rotational speed of the driving motor is disclosed. In this case, the two sensors detect the same mark and therefore variations or the like in positional accuracy, contamination, and mark interval of individual marks are prevented from influencing the control of the rotational speed.

However, a moving speed of a movable member calculated from a passing time of the mark between the two mark detecting means is an average speed of the movable member passing between the two mark detecting means. This average speed is calculated when the mark passes through the second mark detecting means and therefore represents a speed of the movable member at the time before the calculation by a predetermined time, so that detection delay occurs.

In the case where the above-described conventional feedback control is effected by using this average speed, due to the detection delay, phase delay of an integrator occurs and therefore a strong control system cannot be established, so that a servo band cannot be increased. As a result, there arose a problem that control accuracy cannot be enhanced and thus even non-uniformity of a speed at a low frequency cannot be properly controlled.

For example, when the movable mark moves to an average speed of 200 mm/sec and a distance between the two mark detecting means is 10 mm, the average speed in a section of 10 mm obtained by the above-described calculating method is close to a speed at the time when the mark passes through a midpoint of 5 mm from each of the two mark detecting means. In this case, the detection delay corresponding to the passing time in about 5 mm occurs. In the case of the average speed of 200 mm/sec, the detection delay of about 25 msec occurs.

In a driving system of a certain movable member, when there is no detection delay and a control system is established so that the servo band is approximately 10 Hz, the control is sufficiently stable with a phase margin of about 50 degrees. When the above-described detection delay occurs in this system, the detection delay of 25 msec corresponds to the phase delay of 90 degrees at 10 Hz. Therefore, the phase margin is lost, so that phase inversion is caused at several Hz and thus the control becomes unstable. For that reason, the control system had to be established by narrowing the servo band to stabilize the control, thus sacrificing the control accuracy.

SUMMARY OF THE INVENTION

A principal object of the present invention is to provide an image forming apparatus capable of effecting driving speed control of a belt member with high accuracy.

According to an aspect of the present invention, there is provided an image forming apparatus comprising: a rotatable image bearing member provided with a mark; driving means for rotationally driving the image bearing member; first detecting means for detecting speed information of the image bearing member by detecting the mark moved in a predetermined first distance; second detecting means for detecting speed information of the image bearing member by detecting the mark moved in a second distance shorter than the predetermined first distance; a filter circuit for suppressing a high-frequency part of an output from the first detecting means and a low-frequency part of an output from the second detecting means; a calculating portion for calculating a speed of the image bearing member detected from an output from the filter circuit; and a controller for controlling the driving means so that the calculated speed of the image bearing member is a set speed.

These and other objects, features and advantages of the present invention will become more apparent upon a consideration of the following description of the preferred embodiments of the present invention taken in conjunction with the accompanying drawings.

Figure 5:
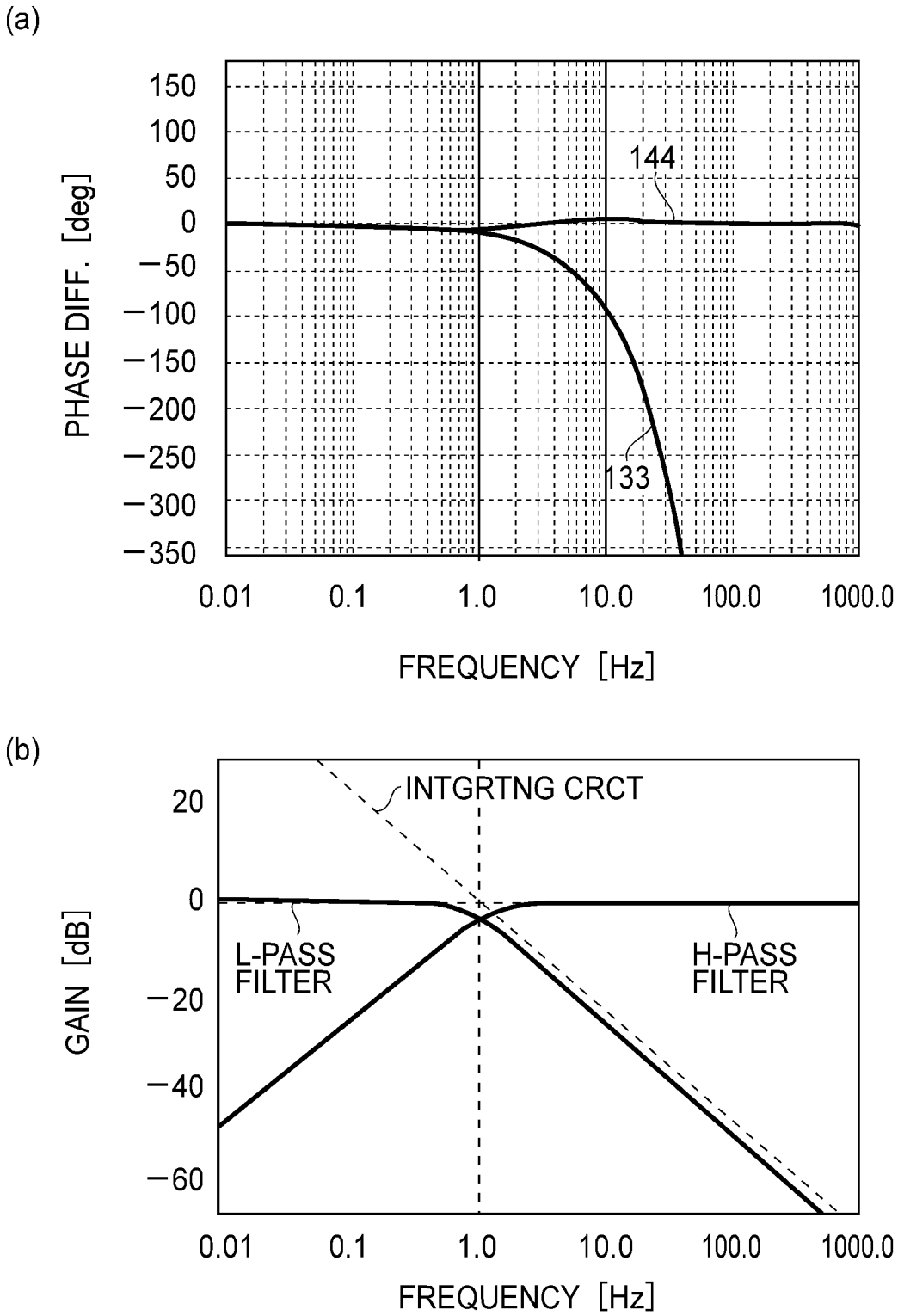

Part (a) of FIG. 5 is an illustration of phase delay, and (b) of FIG. 5 is an illustration of a filter characteristic.

Figure 6:
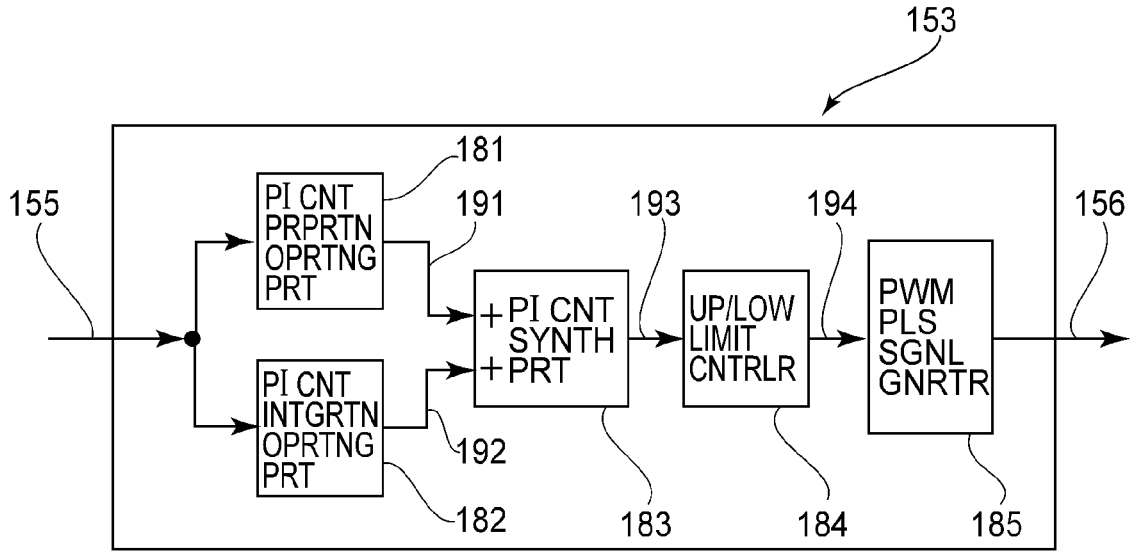

FIG. 6 is an illustration of a constitution of a motor designated value operation part.

Figure 7:
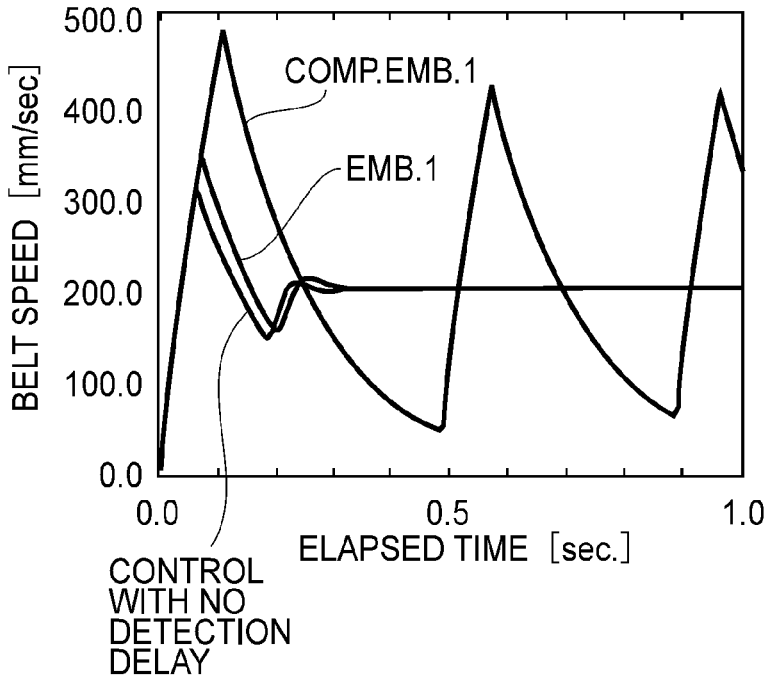

FIG. 7 is an illustration of an effect of control in Embodiment 1.

Figure 8:
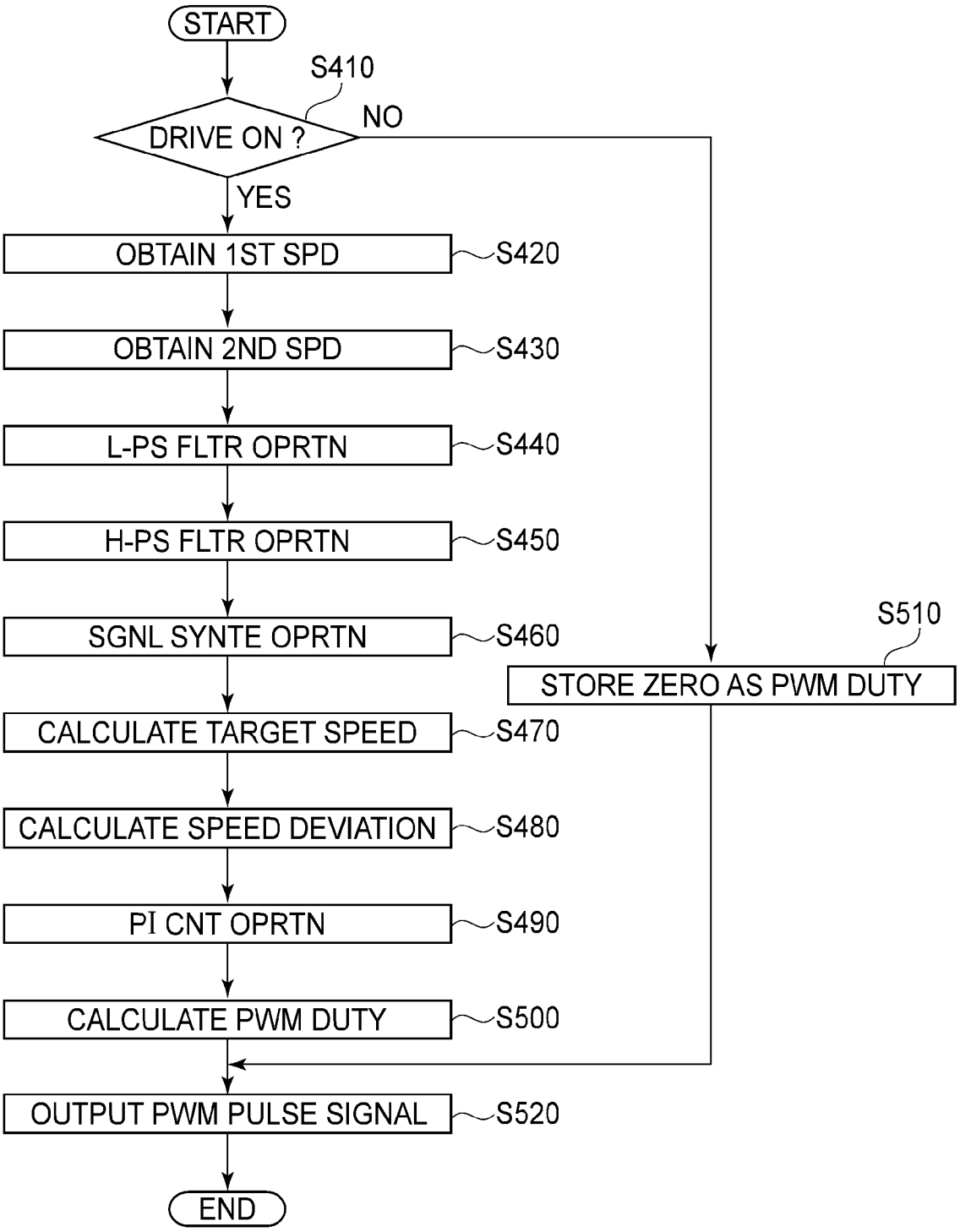

FIG. 8 is a flow chart of control in Modified Embodiment of Embodiment 1.

Figure 9:
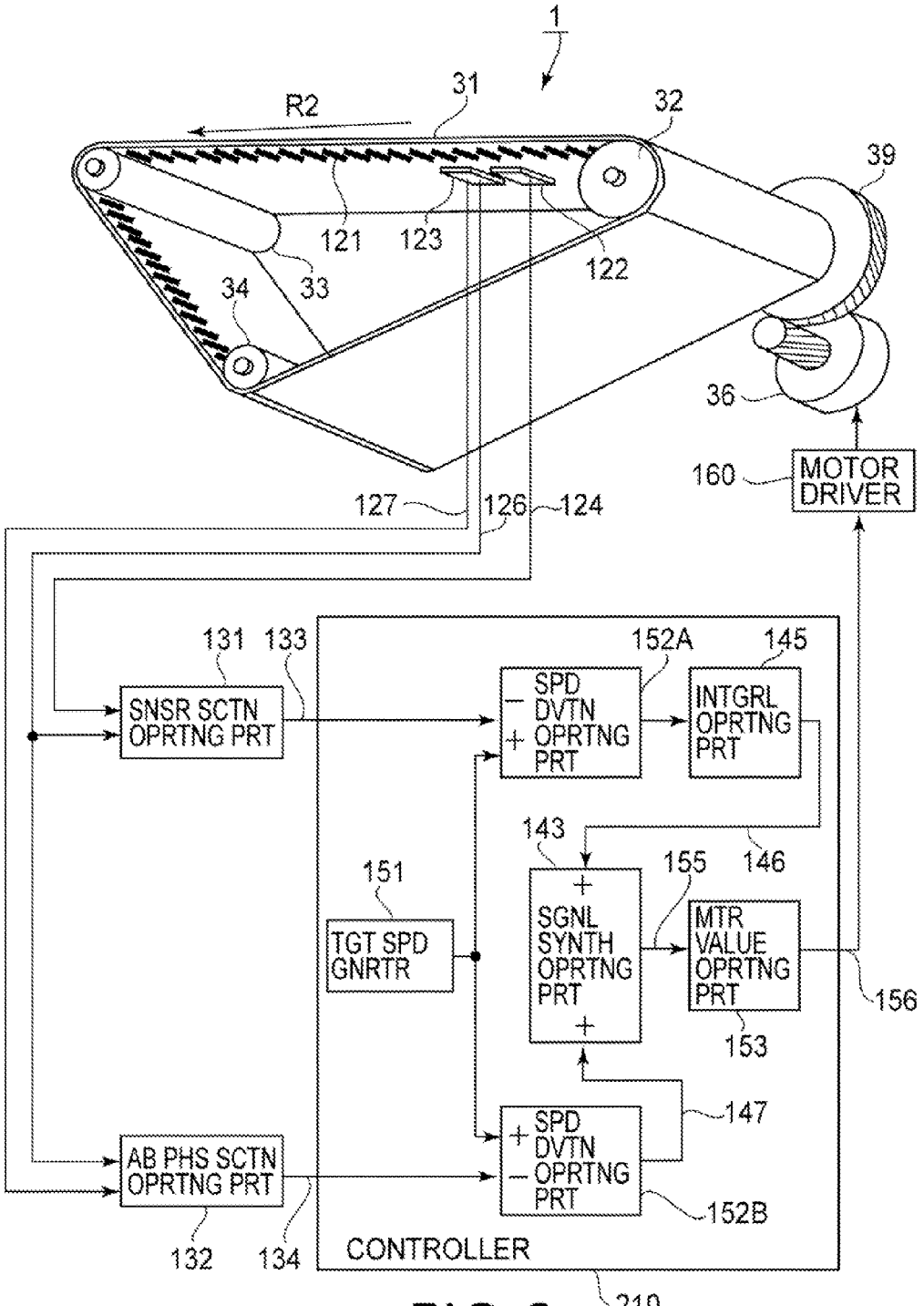

FIG. 9 is a block diagram of intermediary transfer belt drive control in Embodiment 2.

Figure 10:
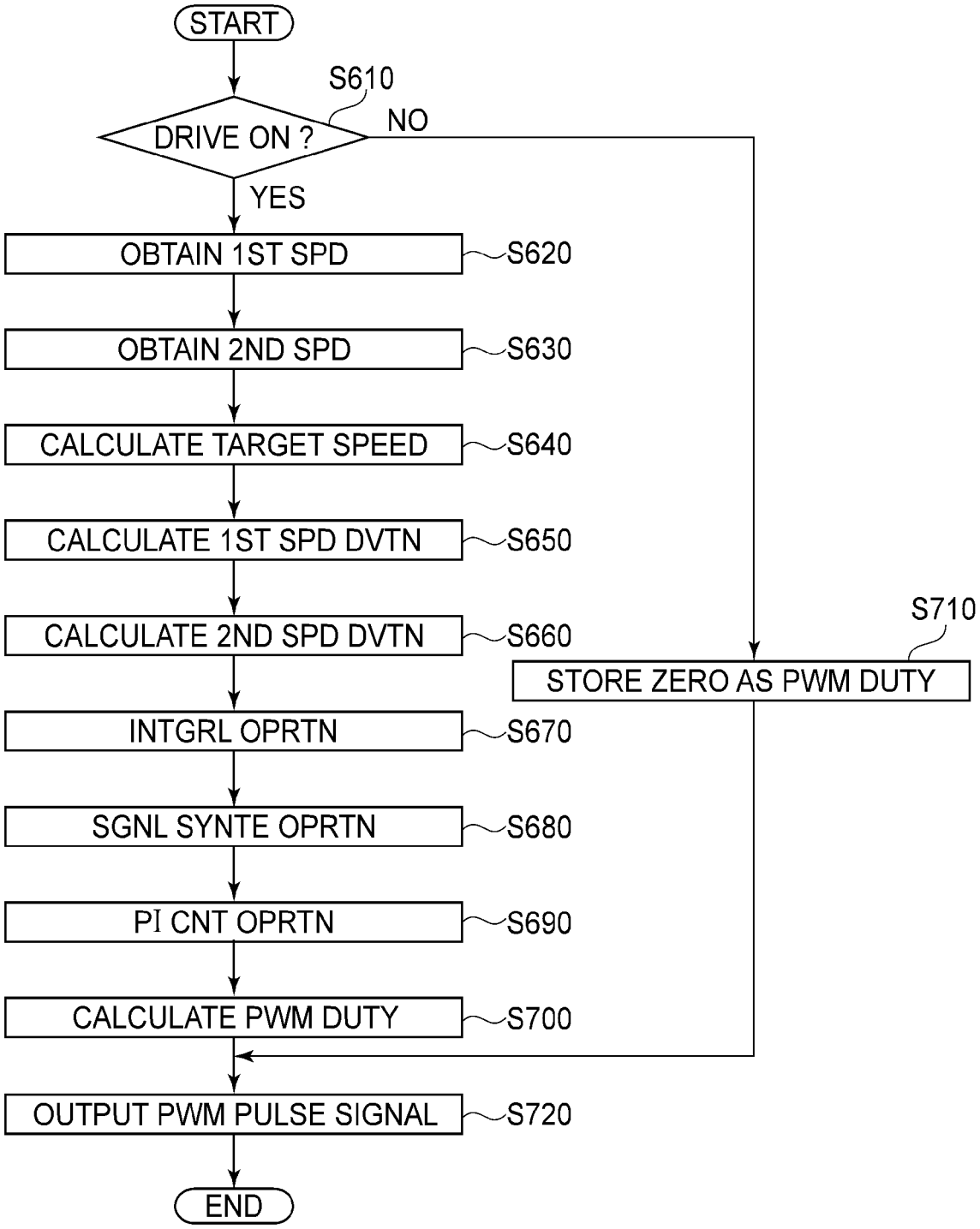

FIG. 10 is a flow chart of control in Modified Embodiment of Embodiment 2.

Figure 11:
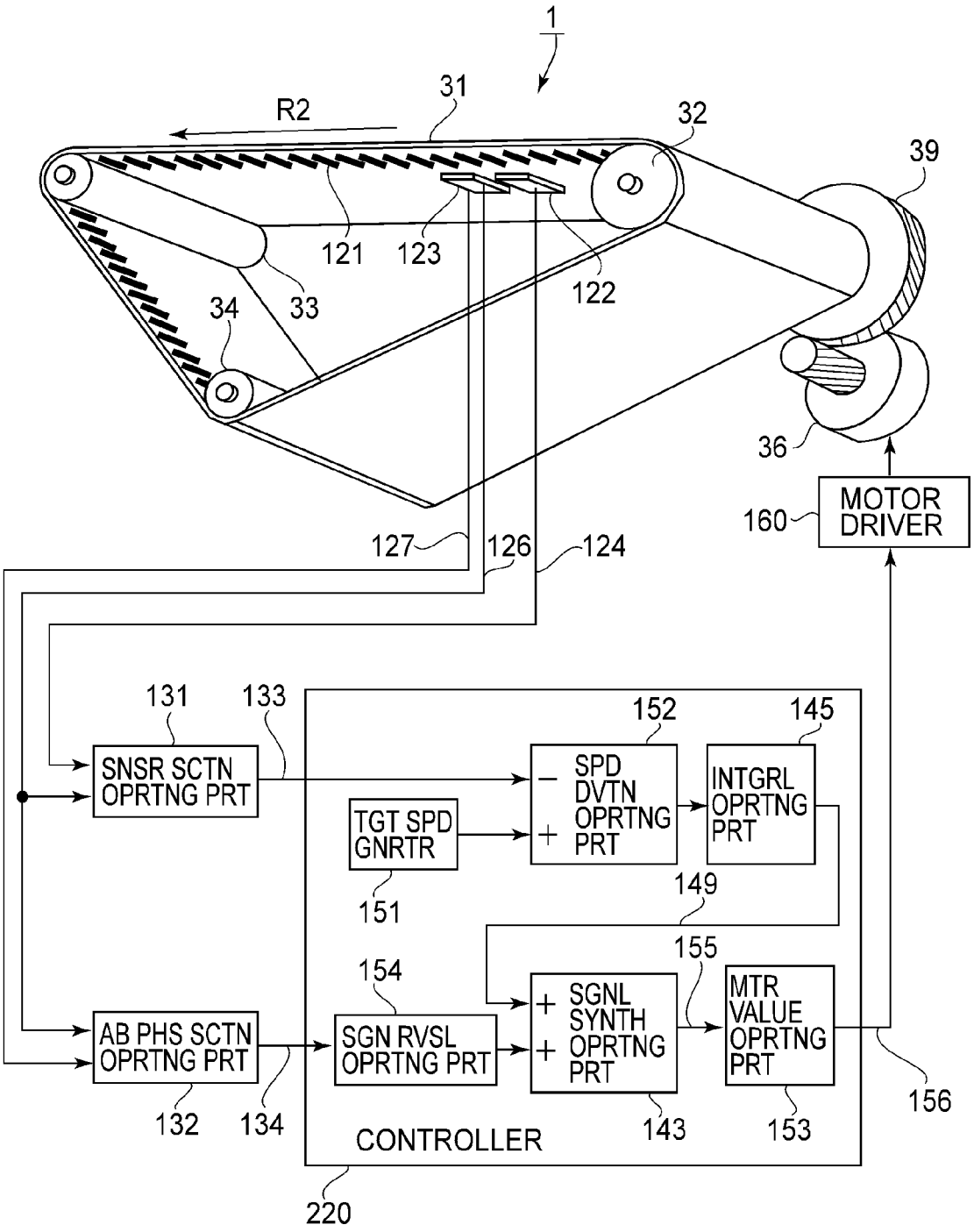

FIG. 11 is a block diagram of intermediary transfer belt drive control in Embodiment 3.

Figure 12:
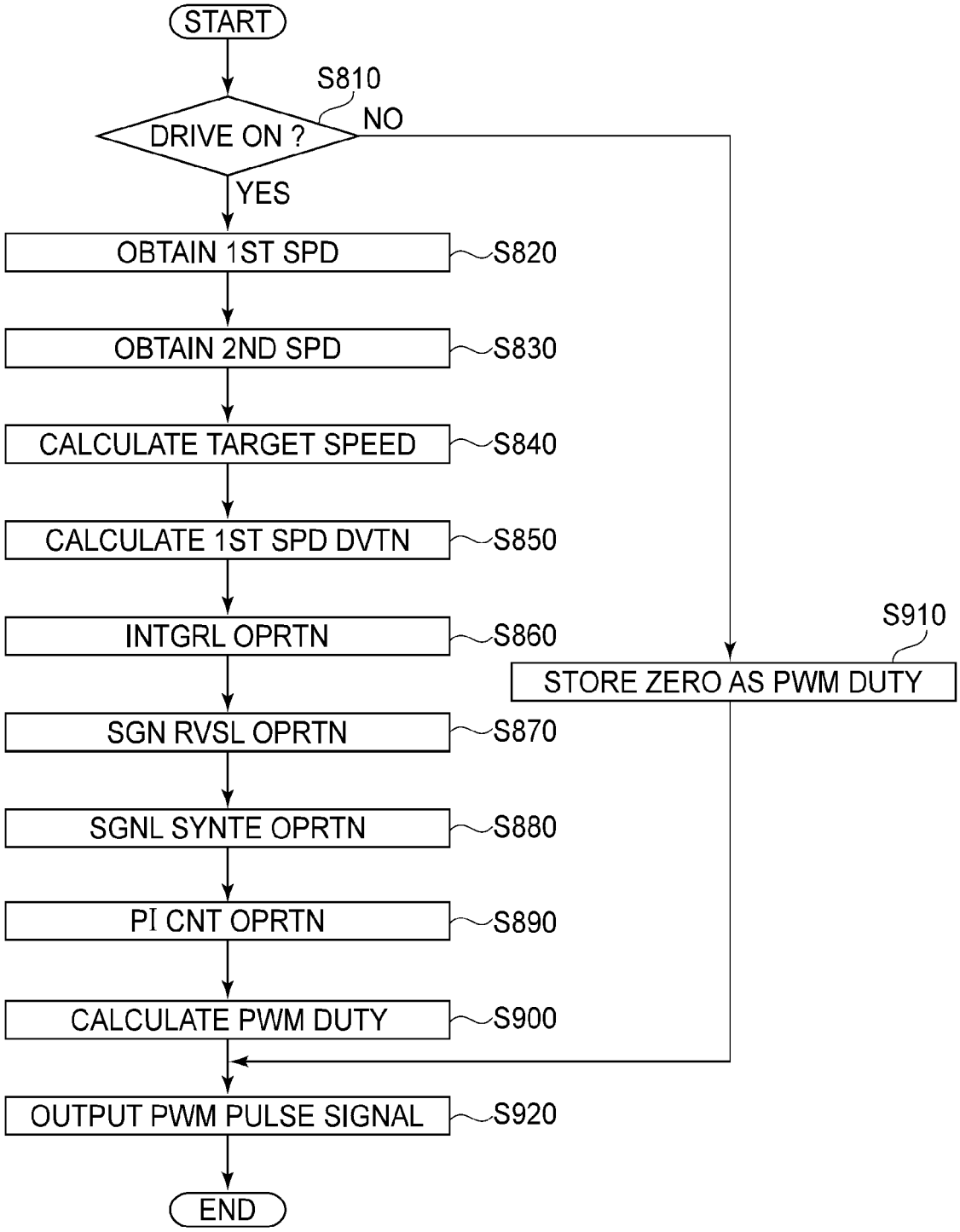

FIG. 12 is a flow chart of control in Modified Embodiment of Embodiment 3.

Figure 13:
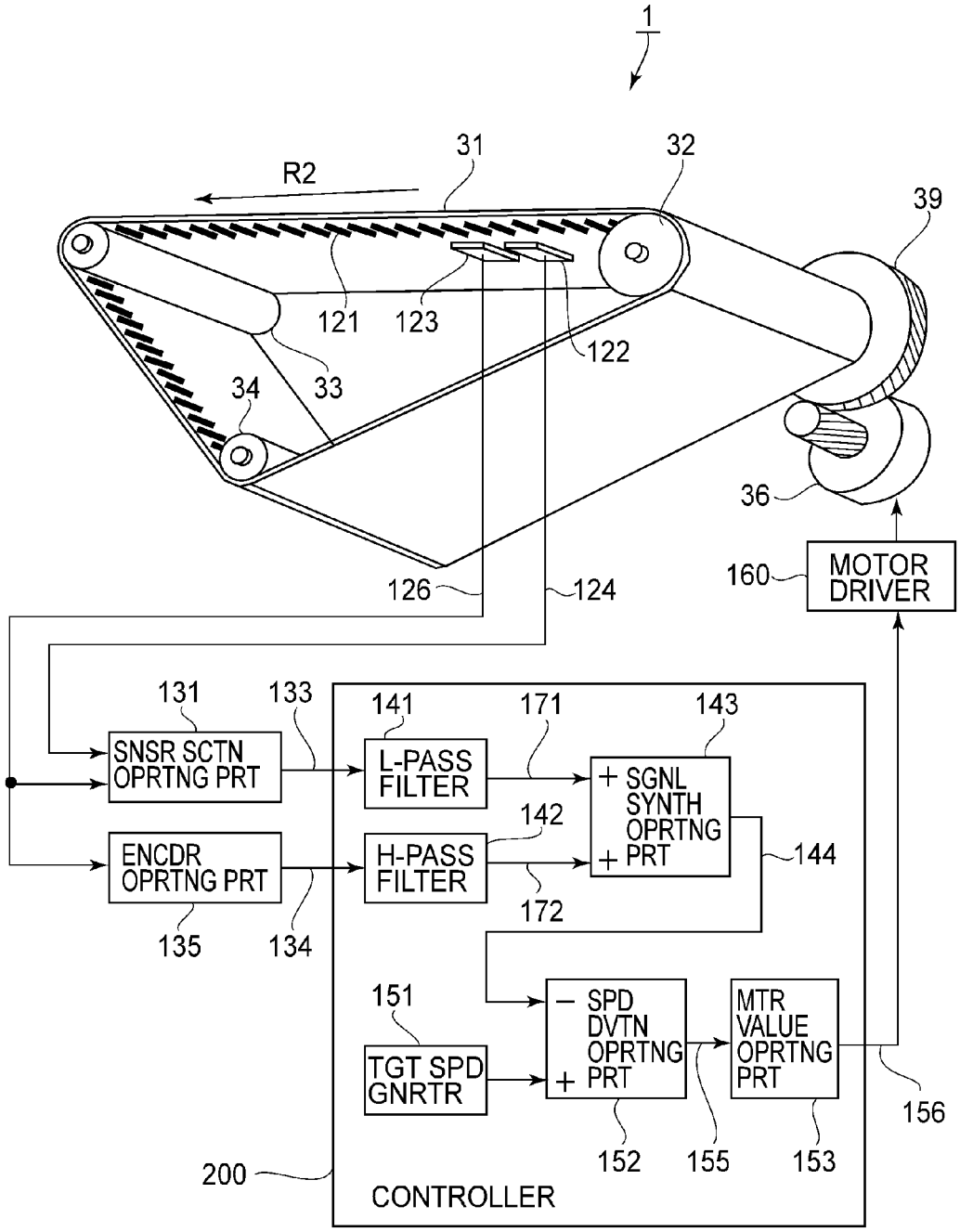

FIG. 13 is a block diagram of intermediary transfer belt drive control in Embodiment 4.

Figure 14:
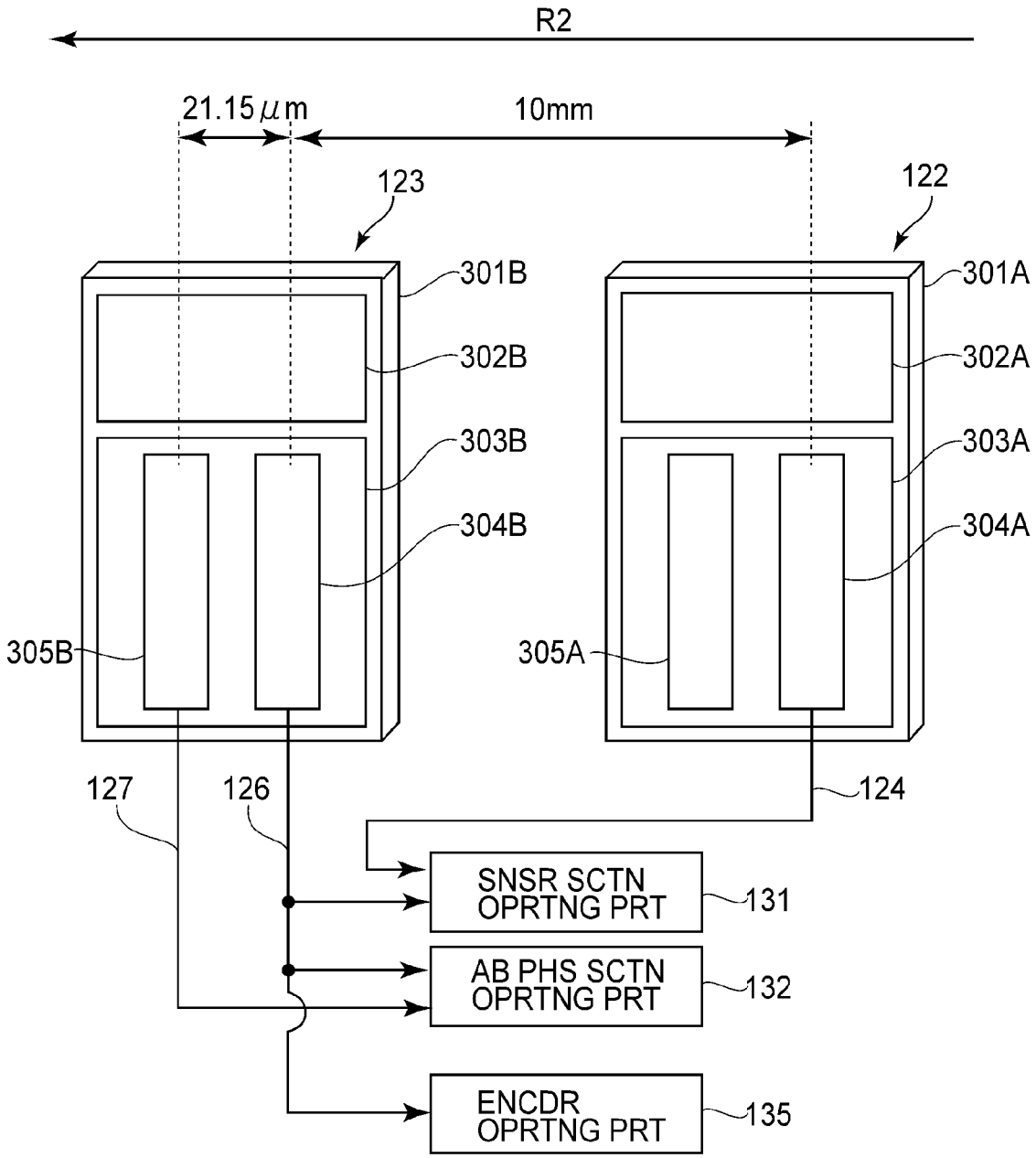

FIG. 14 is an illustration of a mark detecting sensor in Embodiment 4.

Figure 15:
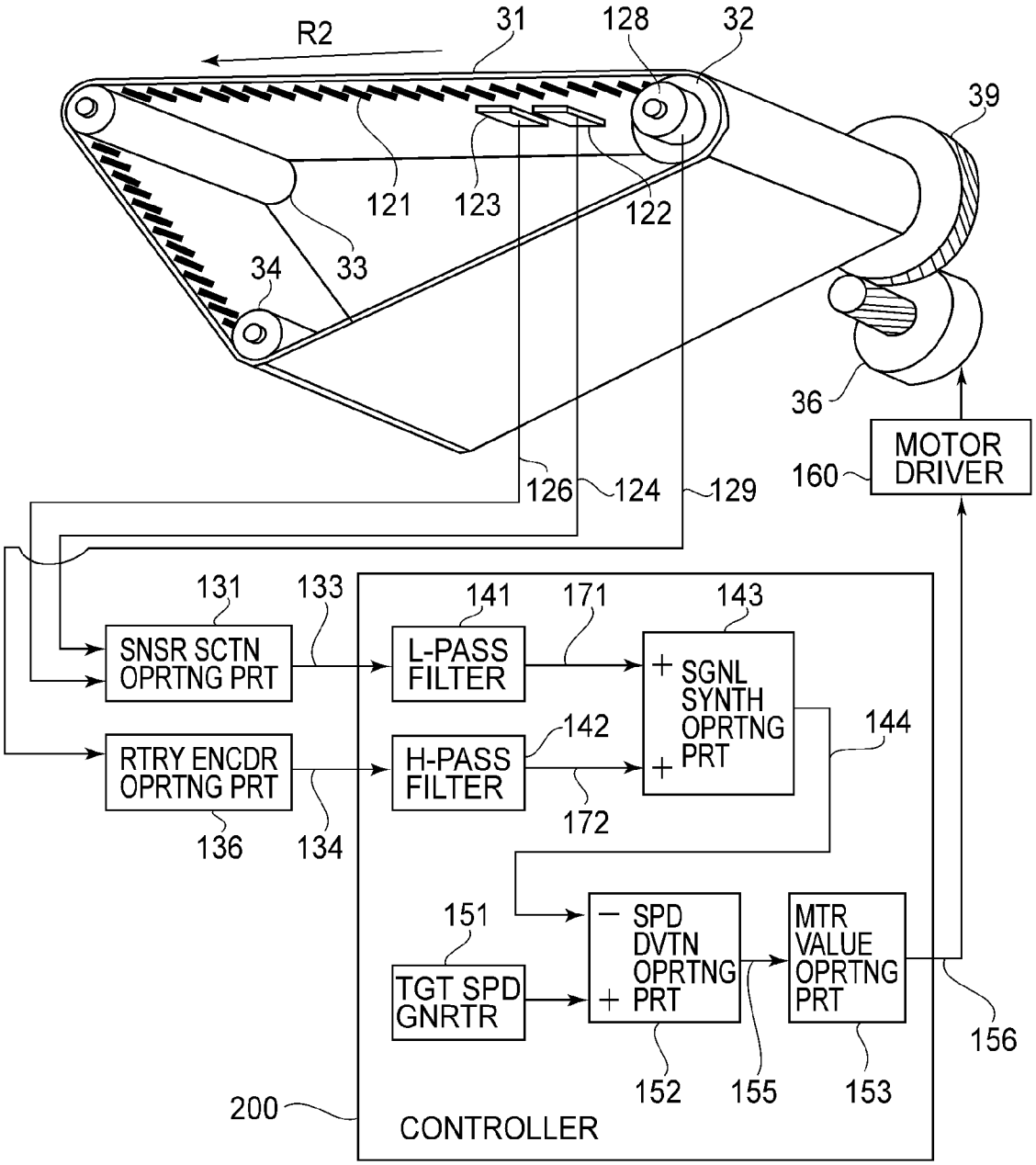

FIG. 15 is a block diagram of intermediary transfer belt drive control in Embodiment 5.

DESCRIPTION OF THE PREFERRED EMBODIMENTS

Hereinbelow, embodiments of the present invention will be described in detail with reference to the drawings. The image forming apparatus according to the present invention can also be carried out in other embodiments in which a part or all of constituents of the respective embodiments are replaced with their alternative constituents so long as a rotational speed of an image bearing member is controlled by using a sensor pair with a long sensor interval and a sensor pair with a short sensor interval.

Therefore, when the image forming apparatus uses a photosensitive member, an intermediary transfer member or a recording material conveying member, the present invention can be carried out irrespective of differences of a charging method, an exposure method, a developing method, a transfer method, a tandem/one drum type, an intermediary transfer/recording material conveyance/direct transfer type, and a monochromatic/full color image formation. A member subjected to drive control is not limited to an intermediary transfer belt but may also be rotatable members such as a photosensitive drum, a photosensitive belt and an intermediary transfer drum.

In the following embodiments, only a principal portion concerning formation/transfer of the toner image will be described but the present invention can be carried out in various uses including printers, various printing machines, copying machines, facsimile machines, multi-function machines, and so on by adding necessary equipment, options, or casing structures.

<Image Forming Apparatus>

Figure 1:
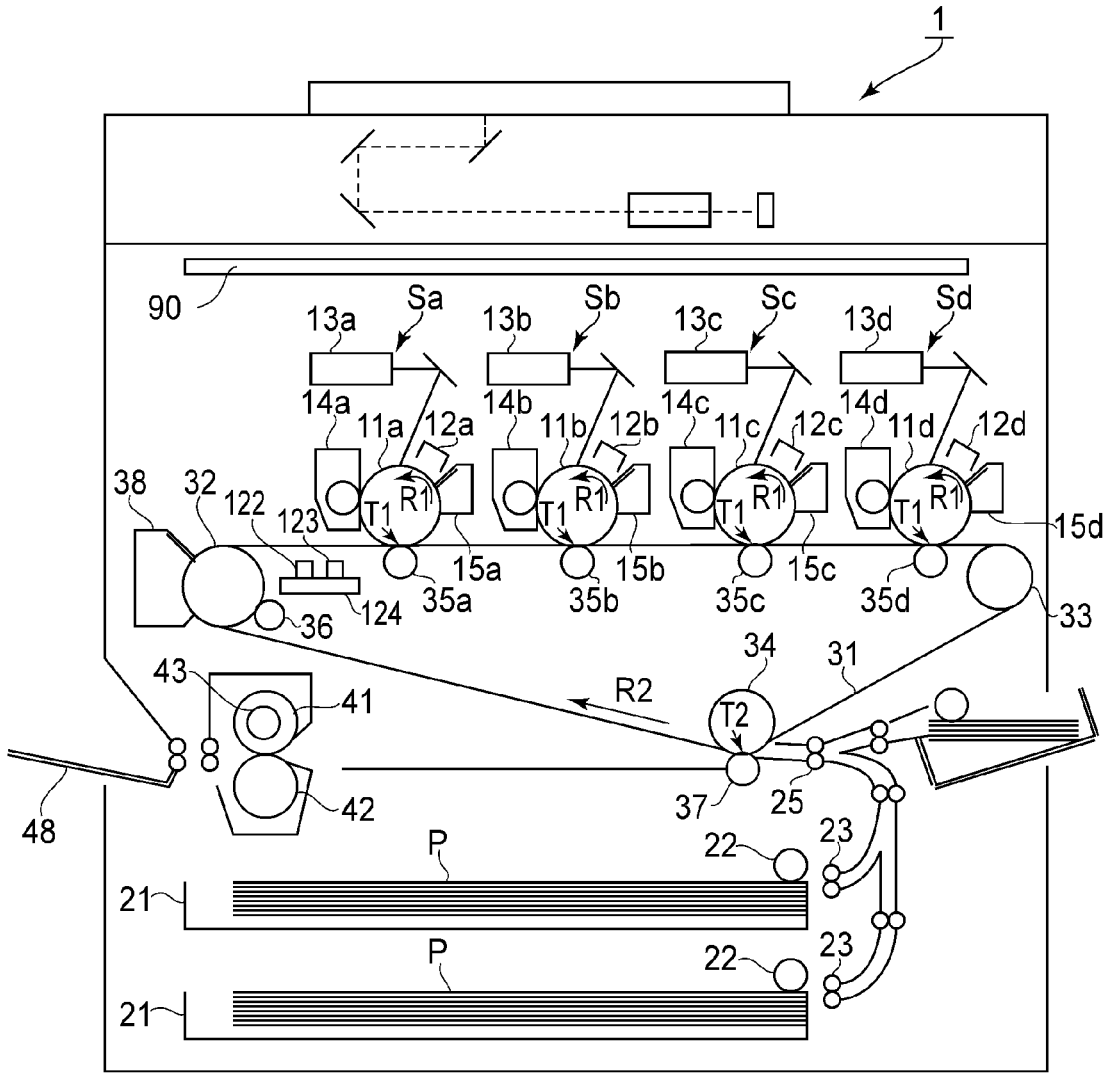
FIG. 1 is an illustration of a structure of an image forming apparatus.

FIG. 1 is a schematic view for illustrating a structure of an image forming apparatus.

As shown in FIG. 1, an image forming apparatus 100 is a tandem-type full-color printer of an intermediary transfer type in which four image forming stations (portions) Sa, Sb, Sc and Sd for yellow, magenta, cyan and black, respectively, are arranged along an intermediary transfer belt 31.

In the image forming station Sa, a yellow toner image is formed on a photosensitive drum 11*a* and then is transferred onto the intermediary transfer belt 31. In the image forming station Sb, a magenta toner image is formed on a photosensitive drum 11*b* and is transferred onto the intermediary transfer belt 31. In the image forming stations Sc and Sd, a cyan toner image and a black toner image are formed on photosensitive drums 11*c* and 11*d*, respectively, and are successively transferred onto the intermediary transfer belt 31.

The four color toner images carried on the intermediary transfer belt 31 are conveyed to a secondary transfer portion T2, at which the toner images are collectively secondary-transferred onto a recording material P.

The recording material P picked up by a pick-up roller 22 from a recording material cassette 21 is separated one by one by a separating roller 23 and then is fed toward registration rollers 25.

The registration rollers 25 sends the recording material P to the secondary transfer portion T2 while timing the recording material P to the toner images on the intermediary transfer belt 31.

In a process in which the recording material P and the toner images superposed thereon are nip-conveyed through the secondary transfer portion T2, a DC voltage is applied to a secondary transfer roller 37, so that a full-color toner image is secondary-transferred from the intermediary transfer belt 31 onto the recording material P. Transfer residual toner remaining on the intermediary transfer belt 31 is collected by a belt cleaning device 38.

The recording material P on which the toner images are secondary-transferred is curvature-separated from the intermediary transfer belt 31 and is sent into a fixing device 40 in which the recording material P is, after being subjected to heat and pressure application to fix the toner images on a surface thereof discharged on a discharge tray 48. In the fixing device 40, a pressing roller 42 is press-contacted to a fixing roller 41 provided with a heater 43 to form a heating nip.

The image forming stations Sa, Sb, Sc and Sd have the same constitution except that colors of the toners used in developing devices 14*a*, 14*b*, 14*c* and 14*d* are yellow, magenta, cyan and black, respectively, which are different from each other. For this reason, in the following, the image forming station Sa will be described and with respect to other image forming stations Sb, Sc and Sb, suffix a of reference numerals (symbols) for representing constituent elements (means) for the image forming station Sa is to be read as b, c and d, respectively, for explanation of associated ones of the constituent elements for the image forming stations Sb, Sc and Sd.

At the image forming station Sa, around the photosensitive drum 11*a*, a corona charger 12*a*, an exposure device 13*a*, the developing device 14*a*, a transfer roller 35*a* and a drum cleaning device 15*a* are disposed. The photosensitive drum 1*a* is prepared by forming a negatively chargeable photosensitive layer on an outer peripheral surface of an aluminum cylinder and is rotatably supported at end portions, and is driven by an unshown motor to rotate in an arrow R1 direction.

The corona charger 12*a* charges the surface of the photosensitive drum 11*a* to a uniform negative potential. The exposure device 13*a* scans the surface of the photosensitive drum 11*a* with a laser beam obtained by ON/OFF modulation of a scanning signal (image data) obtained by developing a separated color image of yellow, so that an electrostatic image for a yellow image is written (formed) on the photosensitive drum 11*a*.

The developing device 14*a* supplies the negatively charged toner to the photosensitive drum 11*a* to deposit the toner on an exposed portion of the electrostatic image, thus reversely developing the electrostatic image.

The primary transfer roller 35*a* is press-contacted to the intermediary transfer belt 31 toward the photosensitive drum 11*a* to form the primary transfer portion T1 between the photosensitive drum 11*a* and the intermediary transfer belt 31. In a process in which the toner image carried on the photosensitive drum 11*a* passes through the primary transfer portion T1, a positive DC voltage is applied to the primary transfer roller 35*a*, so that the toner image is primary-transferred onto the intermediary transfer belt 31.

The cleaning device 15*a* removes the transfer residual toner which passes through the primary transfer portion T1 and remains on the surface of the photosensitive drum 11*a*.

<Intermediary Transfer Belt>

The intermediary transfer belt 31 is extended around and supported by a driving roller 32, a steering roller 33 also functioning as a tension roller, and a back-up roller 34. The intermediary transfer belt 31 is driven by a motor 36 for rotating the driving roller 32 and is rotated in a direction of an indicated arrow R2 at a process speed of 200 mm/sec. The motor 36 as an example of a driving means drives and rotates the intermediary transfer belt 31 as an example of the image bearing member.

The intermediary transfer belt 31 is formed in an endless form, of a polyimide (PI) resin material containing carbon black for imparting resistivity to the intermediary transfer belt 31. The intermediary transfer belt 31 may also be formed of polyvinylidene fluoride (PVdF) or the like.

The steering roller 33 is tilt-controlled depending on a lateral shift position of the intermediary transfer belt 31, thus positioning the intermediary transfer belt 31 with respect to a widthwise direction. The back-up roller 34 is connected to the ground potential and bends a circulatory path of the intermediary transfer belt 31 on a downstream side of the secondary transfer portion T2, so that the recording material P attached to the intermediary transfer belt 31 is curvature-separated from the intermediary transfer belt 31.

The secondary transfer roller 37 is a rubber roller to which electroconductivity is imparted and is press-contacted to the intermediary transfer belt 31 supported by the back-up roller 34 to form the secondary transfer portion T2 between the intermediary transfer belt 31 and the secondary transfer roller 37.

A belt cleaning device 38 removes transfer residual toner which passed through a secondary transfer portion T2 and remains on the intermediary transfer belt 31.

Embodiment 1

Figure 2:
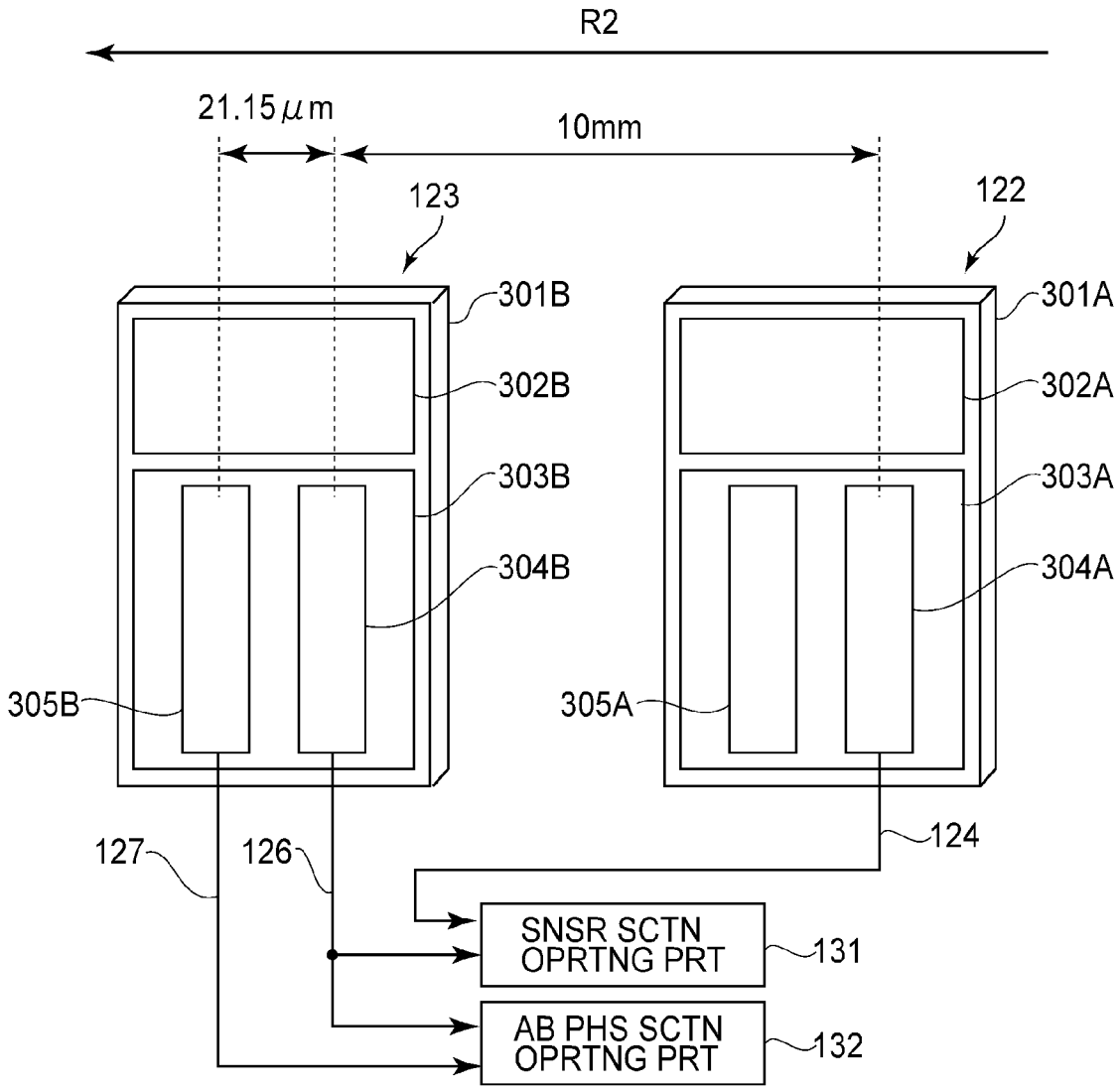
FIG. 2 is an illustration of a mark detecting sensor.
Figure 3:
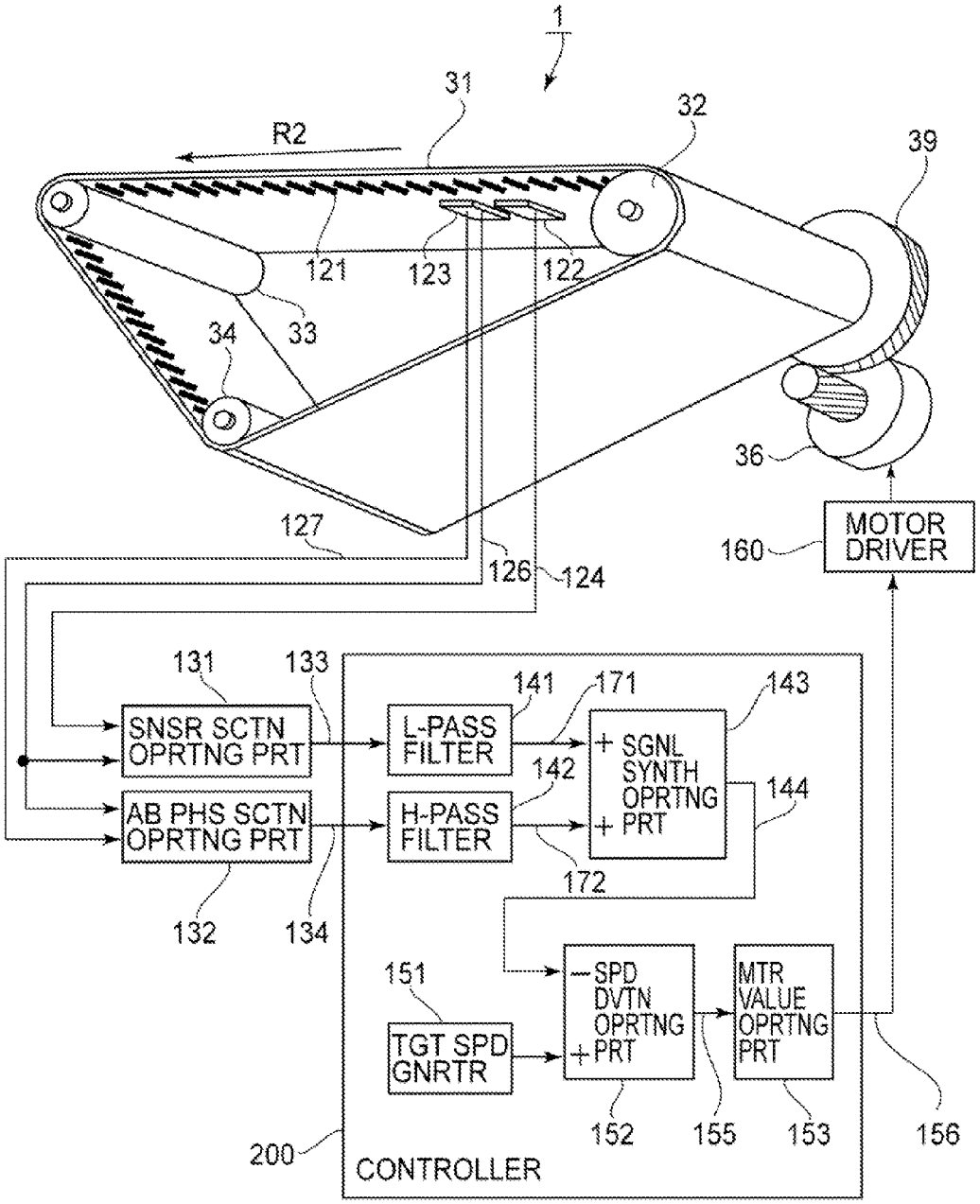
FIG. 3 is a block diagram of intermediary transfer belt drive control in Embodiment 1.
Figure 4:
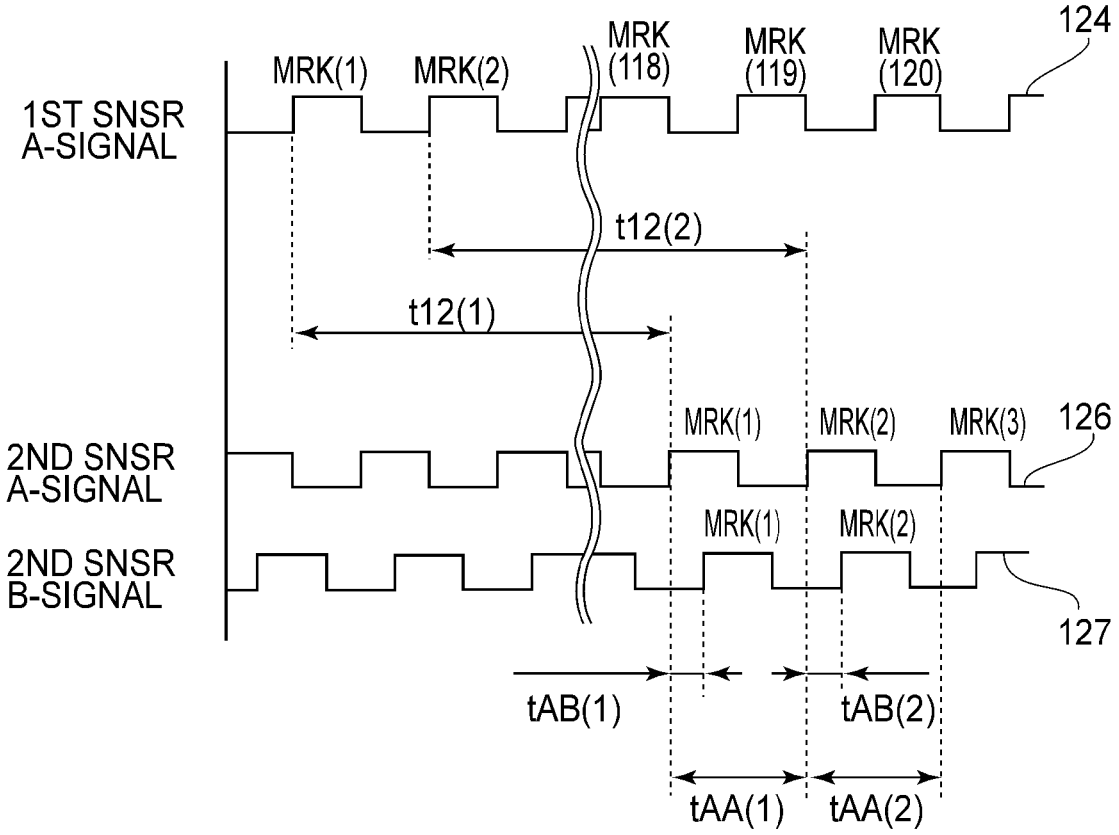
FIG. 4 is an illustration of a detection signal of the mark detecting sensor.

FIG. 2 is an illustration of a mark detecting sensor. FIG. 3 is a block diagram of intermediary transfer belt drive control in Embodiment 1. FIG. 4 is an illustration of a detection signal of the mark detecting sensor. Part (*a*) of FIG. 5 is an illustration of phase delay, and (*b*) of FIG. 5 is an illustration of a filter characteristic. FIG. 6 is an illustration of a constitution of a motor designated value operation part. FIG. 7 is an illustration of an effect of control in Embodiment 1.

As shown in FIG. 1, in an image forming apparatus 1, in order to suppress positional deviation by suppressing a fluctuation in rotational speed of the intermediary transfer belt 31, a conveyance speed of the intermediary transfer belt 31 is detected to be corrected in real time. In order to detect the conveyance speed of the intermediary transfer belt 31, scale-like marks 121 are provided on an inner peripheral surface of the intermediary transfer belt 131 so as to be continued over one full circumference. The marks 121 are formed in a scale-like shape along the rotational direction of the intermediary transfer belt 131. An interval of the marks 121 is 84.6 μm as a scale of a resolution of 300 dpi.

As shown in FIG. 3 with reference to FIG. 2, a first mark detecting sensor 122 and a second mark detecting sensor 123 which are an example of a sensor are provided with a distance with respect to the rotational direction of the intermediary transfer belt 131. An A-phase light receiving portion 304B and a B-phase light receiving portion 305B which are an example of another sensor are provided with a distance shorter than that between the first mark detecting sensor 122 and the second mark detecting sensor 123. An arrangement interval between the A-phase light receiving portion 304B and the B-phase light receiving portion 305B is shorter than the interval of the marks 121 adjacent to each other in the scale-like shape. T A-phase light receiving portion 304B for effecting an output to a sensor section detection operation part 131 also functions as that for effecting an output to an AB-phase section detection operation part 132.

The sensor section detection operation part 131 as an example of a first detecting means detects the same mark formed on the intermediary transfer belt 131 by using the first mark detecting sensor 122 and the second mark detecting sensor 123 to obtain a first detected speed 133 as an example of first speed information. The AB-phase section detection operation part 132 as an example of a second detecting means detects the same mark formed no the intermediary transfer belt 131 by using the A-phase light receiving portion 304B and the B-phase light receiving portion 305B to obtain a second detected speed 134 as an example of second speed information.

In order to detect the mark 121 on the intermediary transfer belt 131, the two mark detecting sensors 122 and 123 are provided on a supporting member 124 along a movement direction of the intermediary transfer belt 131. The first mark detecting sensor 122 is disposed upstream of the second mark detecting sensor 123 with respect to the rotational direction of the intermediary transfer belt 131 which rotates in the arrow R2 direction while opposing the first mark detecting sensor 122. The first mark detecting sensor 122 and the second mark detecting sensor 123 include light emitting portions 302A and 302B, respectively, for an LED and light receiving portions 303A and 303B, respectively, for a photodiode which are provided fixedly on casings 301A and 301B, respectively.

The A-phase light receiving portion 304A of the first mark detecting sensor 122 and the A-phase light receiving portion 304B of the second mark detecting sensor 123 are provided with an interval of 10 mm.

When the intermediary transfer belt 131 is conveyed (rotated), the marks 121 equidistantly arranged on the intermediary transfer belt 131 successively pass through opposing positions to the first mark detecting sensor 122 and the second mark detecting sensor 123. At that time, an A-phase signal 124 is outputted from the A-phase light receiving portion 304A of the first mark detecting sensor 122, and an A-phase signal 126 is outputted from the A-phase light receiving portion 304B of the second mark detecting sensor 123.

As shown in FIG. 4, the A-phase signal 124 of the first mark detecting sensor 122 and the A-phase signal 126 of the second mark detecting sensor 123 are inputted into the sensor section detection operation part 131 with a delay time corresponding to the interval of 10 mm. The sensor section detection operation part 131 selects the A-phase signals 124 and 126 for the same mark and calculates the "delay time corresponding to the interval of 10 mm".

As a method of discriminating the A-phase signals for the same mark, there is also a method in which an intrinsic characteristic signal pattern is outputted with respect to each of marks different in thickness or arrangement interval. In this embodiment, an intrinsic origin mark present with one full circumference is detected by the first mark detecting sensor 122 and the second mark detecting sensor 123, so that the respective marks are numbered with the intrinsic origin mark as a starting point, thus being discriminated.

The sensor section detection operation part 131 calculates a first detected speed 133, based on sensor section detection, from the A-phase signal 124 of the first mark detecting sensor 122 and the A-phase signal 126 of the second mark detecting sensor 123. The sensor section detection operation part 131 detects passing times of the marks 121 from passing of the A-phase light receiving portion 304A of the first mark detecting sensor 122 to passing of the A-phase light receiving portion 304B of the second mark detecting sensor 123 successively as t12(1), t12(2), . . . , as shown in FIG. 4. The sensor section detection operation part 131 calculates the first detected speeds 133 as V1(1)=10 (mm)/t12(1), V1(2)=10 (mm)/t12(2), . . . , from the detected passing times.

In Embodiment 1, the conveyance speed of the intermediary transfer belt 131 is corrected by drive control and therefore a controller 200 generates a motor command signal by composite operation of the first detected speed 133 and a second detected speed 134. A motor driver 160 drives a motor 36 on the basis of the generated motor command signal. The motor 36 rotates the driving roller 32 via a speed reducer 39, so that the intermediary transfer belt 31 is rotated.

As shown in FIG. 2, the light receiving portion 303B of the downstream second mark detecting sensor 123 includes the A-phase light receiving portion 304B and the B-phase light receiving portion 305B. The A-phase light receiving portion 304B and the B-phase light receiving portion 305B of the second mark detecting sensor 123 are provided with an interval of 21.15 μm. This is because when one period of an output signal of the second mark detecting sensor 123 for detecting the marks 121 with the interval of 84.6 μm is 360 degrees, a phase difference of 90 deg. is provided between the A-phase signal and the B-phase signal.

$$84.6(\mu m)/(360\ \text{deg.}/90\ \text{deg.})=21.5(\mu m)$$

As shown in FIG. 3, the A-phase light receiving portion 304B and the B-phase light receiving portion 305B of the second mark detecting sensor 123 detect the mark 121 on the intermediary transfer belt 131 to output an A-phase signal 126 and a B-phase signal 127 which are different in rising timing of a pulse.

Simultaneously with input of the A-phase signals 124 and 126 of the first and second mark detecting sensors 122 and 123 into the sensor section detection operation part 131, the A-phase signal 126 and the B-phase signal 127 of the second mark detecting sensor 123 are outputted into the AB-phase section detection operation part 132. The AB-phase section detection operation part 132 calculates the second detected speed 134 from the A-phase signal 126 from the A-phase light receiving portion 304B and the B-phase signal 127 from the B-phase light receiving portion 305B.

The AB-phase section detection operation part 132 detects passing times of the marks 121 from passing of the A-phase light receiving portion 304B of the second mark detecting sensor 123 to passing of the B-phase light receiving portion 305B successively as tAB(1), tAB(2), . . . , as shown in FIG. 4.

The AB-phase section detection operation part 132 calculates the second detected speeds 134 by the following equations.

$$V2(1)=21.15(\mu m)/tAB \quad (1)$$

$$V2(2)=21.15(\mu m)/tAB \quad (2)$$

$$V2(3)=21.15(\mu m)/tAB \quad (3)$$

The controller 200 has an electric circuit as shown in FIG. 3 and is provided on a control substrate (board) 90 shown in FIG. 1. The controller 200 includes a low-pass filter 141, a high-pass filter 142, a signal composite (synthesizing) operation part 143, a target speed generator 151, a speed deviation operation part 152 and a motor command value operation part 153.

The controller 200 as an example of a control means feed backs the first detected speed 133 and the second detected speed 134, thus controlling the motor 36. The controller 200 feeds back the second detected speed 134 with a proportion higher than that of the first detected speed 133 with respect to a speed fluctuation of not less than a predetermined frequency of the intermediary transfer belt 131. However, with respect to the speed fluctuation of less than the predetermined frequency, the controller feed backs the first detected speed 134 with a proportion higher than that of the second detected speed 134. The predetermined frequency is, as described later in Comparative Embodiment, lower than a frequency of the speed fluctuation of the intermediary transfer belt 131 caused in the case where only the first detected speed 133 is fed back thereby to control the motor 36.

The low-pass filter 141 attenuates, when the frequency at which the influence of the "delay time corresponding to the interval of 10 mm" appears is defined as a cut-off frequency, a signal component of not less than the cut-off frequency. The low-pass filter 141 extracts, from the first detected speed 133, a signal in a low frequency range including a DC component less affected by the "delay time corresponding to the interval of 10 mm".

The high-pass filter 142 has the same cut-off frequency as the low-pass filter 141 and attenuates a signal component of not more than the cut-off frequency. The high-pass filter 142 extracts, from the second detected speed 134, a signal in a frequency range which includes a boundary frequency range of a servo band and in which the control is influenced by the "delay time corresponding to the interval of 10 mm".

Specifically, with respect to the first detected speed 133 with the detection delay of 25 msec which is ½ of an average movement time of 50 msec due to the "delay time corresponding to the interval of 10 mm", as shown in FIG. 5, a phase delay remarkably appears at a signal of 1 Hz or more. Therefore, as shown in (b) of FIG. 5, the low-pass filter 141 and the high-pass filter 142 which have the cut-off frequency of 1 Hz.

The signal composite operation part 143 generates a composite signal 144 by adding a low-pass filter passing signal 171 obtained by filter operation of the first detected speed 133 and a high-pass filter passing signal 172 obtained by filter operation of the second detected speed 134 in real time. Then, the composite signal 144 is increased in feed-back ratio of the first detected speed 133 more than the second detected speed 134 in the frequency range, lower than 1 Hz, including a DC component. Further, in the frequency range, higher than 1 Hz, including the boundary frequency of the servo band, the composite signal 144 is increased in feed-back ratio of the second detected speed 134 more than the first detected speed 133. As a result, the composite signal 144 with substantially no detection delay due to the "delay time corresponding to the interval of 10 mm" is generated.

The speed deviation operation part 152 operates, in order to operate an increase/decrease of the motor command value from a difference between a current detected speed and a target speed, a deviation between the composite signal 144 and the target speed generated by the target speed generation or 151, thus calculating a control operation input signal 155.

As shown in FIG. 6, the motor command value operation part 153 performs operations of PI control and upper and lower limiting control to generate a motor driving command signal 156 to be inputted into a motor driver 160. The motor driving command signal 156 is a PWM pulse signal, and the motor driver 160 drives, on the basis of this PWM pulse signal, the motor 36 which is a DC servo motor.

A PI control proportion operation part 181 calculates a PI control proportion operation value 191 by multiplying the control operation input signal 155 by a proportional parameter. A PI control integral operation part 182 calculates a PI control integral operation value 192 by subjecting to integral operation a value obtained by multiplying the control operation input signal 155 by an integral parameter. A PI control synthesizing portion 183 calculates a PI control composite value by adding the PI control proportion operation value 191 and the PI control integral operation value 192.

A motor drive command value 194 is a PWM duty ratio and therefore has to be a value in a range from 0 to 1. Therefore, an upper and lower limiting controller 184 sets the motor drive command value 194 at 0 when the PI control composite value 193 is a negative value and sets the motor drive command value 194 at 1 when the PI control composite value 193 is a large value. Further, when the PI control composite value 193 is a value between 0 and 1, the motor drive command value 194 is made equal to the PI control composite value 193. A PWM pulse signal generator 185 generates, as the motor drive command signal 156, a pulse signal providing the PWM duty ratio of the motor drive command value 194.

As shown in FIG. 7, the image forming apparatus 1 was actuated and then rising of the peripheral speed of the intermediary transfer belt 31 was measured. In the control in this embodiment, the intermediary transfer belt 31 is subjected to the speed control by using the composite signal 144 which is not substantially influenced by the detection delay due to the "delay time corresponding to the interval of 10 mm". For this reason, similarly as in the case where the speed signal with no detection delay, the speed of the intermediary transfer belt 31 can be caused to converge to 200 mm/sec.

Comparative Embodiment

In Comparative Embodiment, the controller 200 generates the motor drive command signal 156 by effecting PI control such that only the first detected speed 133 is fed back to the rotational speed of the motor 36.

As is understood from the calculating method of the passing times t12(1), t12(2), . . . , the first detected speed 133 is the average speed of the mark 121 passing between the A-phase light receiving portion 304A of the first mark detecting sensor and the A-phase light receiving portion 304B of the second mark detecting sensor. This average speed in the 10 mm section is close to the value of the speed of the mark 121 passing through the point of 5 mm which is ½ of the section (10 mm).

Further, the first detected speed 133 is operated and updated by using the A-phase signal 126 when the mark 121 passes through the second mark detecting sensor 123 and therefore is calculated with a delay, corresponding to a passing time of about 5 mm, from the above-described average speed.

This results in the detection delay of 25 msec when the speed of the intermediary transfer belt 31 is 200 mm/sec. Therefore, the first detected speed 133 has a phase delay characteristic due to the delay time as shown in FIG. 5.

In the case where the feed-back control is effected by using only the first detected speed 133, due to the phase delay, phase delay of the integrator occurs and therefore a strong control system cannot be established, so that the servo band cannot be increased.

In the case of the image forming apparatus 1, the intermediary transfer belt 31 is moved at the average speed of 200 mm/sec, and the distance between the first mark detecting sensor 122 and the second mark detecting sensor 123 is 10 mm. In this case, the average speed of the intermediary transfer belt 31 in the 10 mm section is close to the movement speed of the mark when the mark passes through the point of 5 mm which is ½ of the section. For this reason, a delay corresponding to a time when the intermediary transfer belt 31 is moved by 5 mm occurs.

The intermediary transfer belt 31 passes through the 10 mm section in 50 msec at the movement speed of 200 mm/sec and therefore the detection delay of about 25 msec occurs.

Assuming that a time constant of the driving system of the intermediary transfer belt 31 is 0.16 sec, in the case where the driving system is established so that the servo band is approximately 10 Hz by the PI control, when there is no detection delay, it is possible to provide the phase margin of about 50 deg. as shown in FIG. 7. When there is no detection delay, even at the servo band of about 10 Hz, the phase margin is about 50 deg. and the control is sufficiently stable.

However, in the case where the servo band is 10 Hz, 200 mm corresponds to 10×360 deg. and therefore 360 deg. corresponds to 20 mm, so that the detection delay of 5 mm (25 msec) corresponds to the phase delay of 90 deg. Therefore, the phase margin is lost, so that phase inversion occurs at several Hz and thus the control becomes unstable. When the above-described delay of 25 msec is added to this system, the phase delay of 90 deg. at 10 Hz is added, so that the phase margin is lost and thus the control becomes unstable.

As a result, as shown in FIG. 7, the control diverges. When there is no detection delay, the speed of the intermediary transfer belt 31 can be converged to 200 mm/sec. However, when the feed-back control is effected by using only the first detected speed 133 with the detection delay, the speed is largely increased and decreased to cause oscillation.

For that reason, in Comparative Embodiment, the servo band is designed by being narrowed to 1 Hz to be stabilized, so that accuracy of the speed control had to be sacrificed.

On the other hand, in Embodiment 1, as described above, by effecting the signal synthesizing method by the controller 200, the influence of the detection delay is suppressed, so that the speed control accuracy is improved. As a result, as shown in FIG. 7, the control is converged substantially similarly as in the case where there is no detection delay.

According to the control in Embodiment 1, the single mark is detected and therefore even when there is a mark interval error, the control accuracy can be improved. Further, the second detected speed 134 is obtained by using the AB-phase section detection of the second mark detecting sensor 123 and therefore the influence of the mark interval error is eliminated, so that the control accuracy particularly in the low frequency range can be improved.

In addition, the detection delay influence of the section detection by the two mark detecting sensors is suppressed and therefore the servo band which is a frequency range of followable speed fluctuation can be increased. As a result, the rotational speed fluctuation of the intermediary transfer belt 31 can be suppressed to reduce a degree of the positional deviation during transfer, so that it is possible to prevent a lowering in image quality.

Incidentally, in Embodiment 1, the second detected speed 134 was calculated by the AB-phase section detection of the second mark detecting sensor 123. However, the second detected speed B4 may also be, as shown in FIG. 4, replaced with detected speeds V3 which are shown below and are calculated from time intervals tAA(1), tAA(2), . . . of the marks 121 successively passing through the second mark detecting sensor 123.

$$V3(1)=84.6(\mu m)/tAA \quad (1)$$

$$V3(2)=84.6(\mu m)/tAA \quad (2)$$

$$V3(3)=84.6(\mu m)/tAA \quad (3)$$

However, it is difficult to dispose consecutive mark 121 at a constant interval of 84.6 μm and therefore an interval error of the marks 121 is included in the speed obtained by encoder detection. By passing the second detected speed 134 through the high-pass filter 142, the mark interval error at a low frequency can be reduced. However, the mark interval error is not included in the detected speed by the above-described AB-phase section detection and therefore when the speed obtained by the AB-phase section detection is used, the control accuracy particularly at a low frequency can be improved.

Further, in Embodiment 1, the second detected speed 134 was detected by using the single second mark detecting sensor 123. However, a plurality of second mark detecting sensors 123 may also be arranged along the rotational direction of the intermediary transfer belt 31 to obtain an average of outputs from the second mark detecting sensors 123, so that an error with a short sensor interval may also be reduced.

Further, in Embodiment 1, the calculating method of the first detected speed 133 by the sensor section detection is described based on the passing times between the A phases of the two sensors but the first detected speed 133 may also be calculated from the passing times between the B phases of the two sensors. Similarly, the calculating method of the second detected speed 134 by the AB-phase section detection is described based on the time difference between the A and B phases of the second mark detecting sensor 123 but the second detected speed 134 may also be calculated from the time difference between the A and B phases of the first mark detecting sensor 122.

Further, in Embodiment 1, an example in which the signal band separation is made by using the filters is shown but the filters may also be replaced with a circuit element capable of making a similar band separation, such as an integrating circuit described later.

Further, in Embodiment 1, the control operation by the motor command value operation part 153 is described as an example of the PT control but may also be effected by another feed-back control method such as simple P control or the like.

Further, in Embodiment 1, the passing speed is controlled by converting the data of the detected passing time into the passing speed but may also be controlled by using the data of the passing time as it is.

Modified Embodiment of Embodiment 1

FIG. 8 is a flow chart of control in Modified Embodiment of Embodiment 1. The electric circuit shown in FIG. 3 may preferably be realized by using a program operation of a micro-computer circuit as a part thereof. In this case, the controller 200 includes the micro-computer circuit, a small number of dedicated integrated circuits and a program stored in a non-volatile memory and is provided on the control substrate 90 shown in FIG. 1. Processing for generating the motor drive command signal by the controller 200 is carried out by a CPU of the micro-computer circuit on the basis of the control program stored in the non-volatile memory provided on the control substrate 90.

As shown in FIG. 8 with reference to FIG. 3, the controller 200 discriminates whether or not a drive ON signal of the intermediary transfer belt 31 outputted from the CPU which manages the control of respective parts of the image forming apparatus 1 is effective (S410). In the case where the ON signal is not effective (drive OFF) (NO of S410), zero is stored as a PWM duty ratio D (S510). However, in the case where the ON signal is effective (drive ON) (YES of S410), the first detected speed 133 is calculated by the operation and then extracts and stores a calculated speed value V1 (S420). The passing time of the mark 121 from passing of the A-phase light receiving portion 304A of the first mark detecting sensor 122 to passing of the A-phase light receiving portion 304B of the second mark detecting sensor 123 is detected and then the first detected speed 133 is calculated from this passing time. The calculated value of the first detected speed 133 is extracted from the sensor section detection operation part 131 and is stored.

The controller 200 operates the second detected speed 134 and then extracts and stores the calculated speed value V2 (S430). The passing time of the mark 121 from passing of the A-phase light receiving portion 304B of the second mark detecting sensor 123 to passing of the B-phase light receiving portion 305B of the second mark detecting sensor 123 is detected and then the second detected speed 134 is calculated from this passing time. The calculated value of the second detected speed 134 is extracted from the AB-phase section detecting operation part 132 and is stored.

The controller 200 performs the operation of the low-pass filter by using, as an input, the speed value V1 stored in the step S420, and then stores a calculated value Vf1 (S440). Further, the controller 200 performs the operation of the high-pass filter by using, as an input, the speed value V2 stored in the step S430, and then stores a calculated value Vf2 (S450).

The controller 200 adds the value Vf1 stored in the step S440 and the value Vf2 stored in the step S450 and then stores a calculated value Vs (S460). Further, the controller 200 operates a target speed at a subsequent sampling time and then stores a calculated value Vo (S470).

The controller 200 subtracts the value Vs stored in the step S460 from the speed value Vo stored in the step S470 and then stores a calculated speed deviation Vd (S480). Further, the PI control operation is performed by using, as an input, the speed deviation stored in the step S480 (S490). Then, the controller performs, after calculating a proportional operation value P by multiplying the speed deviation Vd by a proportional parameter, integral operation to calculate an integral operation value I. This integral operation is performed by accumulating values each obtained by multiplying the speed deviation Vd by the integral parameter and the sampling time. Then, the proportional operation value P and the integral operation value I are added to calculate a control value C.

The controller 200 stores zero as the PWM duty ratio D when the control value C calculated in the step S490 is a negative value, and stores 1 as the PWM duty ratio D when the control value C is a value larger than 1. Further, when the control value C is a value between 0 and 1, the controller 200 stores the control value C as the PWM duty ratio D (S500).

The controller 200 generates a pulse signal with the PWM duty ratio D stored in the step S500 or the step S510 (S520). Thereafter, every sampling time of the controller 200, the flow up to the steps 520 is periodically repeated to effect the drive control.

Embodiment 2

FIG. 9 is a block diagram of intermediary transfer belt drive control in Embodiment 2. In Embodiment 1, the method in which the frequency ranges of the detection signals are cut by using the filters and are synthesized to generate the speed signal from which the detection delay is eliminated was described. In Embodiment 2, a method in which a speed signal from which the detection delay is eliminated by integral operation of the first detected speed will be described. This is because the integral operation has a characteristic such that a signal amplification in a low frequency range and a signal attenuation in a high frequency range are realized.

As shown in FIG. 9, a control constitution in this embodiment is the same as that in Embodiment 1 except for an interior constitution of a controller 210. Further, a part of the interior constitution of the controller 210 is also the same as that in Embodiment 1. For this reason, in FIG. 9, constituent elements (parts) which are the same as those in FIG. 3 of Embodiment 1 are represented by the same reference numerals and will be omitted from redundant description.

The controller 210 is provided, as the electric circuit, on the control substrate 90. The controller 210 includes the signal synthesizing operation part 143, the integrating operation part 145, the target speed generator 151, speed deviation operation parts 152A and 152B, and the motor command value operation part 153.

The speed deviation operation part 152A of the controller 210 operates, in order to operate the fluctuation (increase/decrease) of the motor command value from the difference between the current detected speed and the target speed, the deviation between the first detected speed 133 obtained by the sensor section detection and the target speed generated by the target speed generator 151.

The integrating operation part 145 uses the frequency, at which the detection delay influence appears, as a zero cross frequency as indicated by broken lines in (b) of FIG. 5, and amplitudes the signal component not more than the zero cross frequency and attenuates the signal component not less than the zero cross frequency. The integrating operation part 145 generates, from the above deviation, a deviation integration signal 146 by amplifying the low frequency range signal including the DC component with less detection delay influence and by attenuating a signal in a frequency range, influenced by the detection delay, including the boundary frequency range of the servo band.

As shown in (a) of FIG. 5, the first detected speed 133 has the detection delay of 25 msec and therefore as described in Embodiment 1, the phase delay remarkably appears with respect to the signal of not less than 1 Hz. For this reason, as shown in (b) of FIG. 5, in the integrating operation part 145, the first detected speed 133 is subjected to integral operation and multiplication ($\times 2.0 \times \pi \times 1$ (Hz)) so that 1 Hz becomes the zero-cross frequency. As a result, the deviation integral signal 146 becomes a signal which is amplified in the frequency range lower than 1 Hz and is attenuated in the frequency range higher than 1 Hz.

The speed deviation operation part 152 generates a deviation signal 147 by operating the deviation between the second detected speed 134 obtained by the AB-phase section detection and the target speed generated by the target speed generator 151. The signal synthesizing operation part 143 calculates the control operation input signal 155 by adding the deviation integral signal 146 and the deviation signal 147 in real time.

When the deviation integral signal 146 and the deviation signal 147 are added, their composite signal 144 is increased in ratio of the first detected speed 133 more than the second detected speed 134 in the frequency range, lower than 1 Hz, including a DC component. Further, in the frequency range, higher than 1 Hz, including the boundary frequency of the servo band, the composite signal 144 is increased in ratio of the second detected speed 134 more than the first detected speed 133. As a result, the control operation input signal 155 with substantially no detection delay is generated.

As shown in FIG. 6, the motor command value operation part 153 performs operations of PI control and upper and lower limiting control to generate a motor driving command signal 156 to be inputted into a motor driver 160. The motor driving command signal 156 is a PWM pulse signal, and the motor driver 160 drives) the motor 36 on the basis of this PWM pulse signal.

In the constitution of Embodiment 2, the integrator is used for the band separation and therefore a gain particularly in a low frequency range becomes large. Therefore, in the low frequency range, the speed control accuracy of the intermediary transfer belt 31 can be improved.

In Embodiment 2, an example in which the signal band separation is made by using the integral operation is shown but the band separation for the first detected speed 133 may also be made by using a control element having a similar function.

Modified Embodiment of Embodiment 2

FIG. 10 is a flow chart of control in Modified Embodiment of Embodiment 1. The electric circuit shown in FIG. 9 includes the micro-computer circuit, a small number of dedicated integrated circuits and a program stored in a non-volatile memory and is provided on the control substrate 90 shown in FIG. 1. Processing for generating the motor drive command signal by the controller 210 is carried out by a CPU of the micro-computer circuit on the basis of the control program stored in the non-volatile memory provided on the control substrate 90.

As shown in FIG. 10 with reference to FIG. 9, the controller 210 discriminates whether or not a drive ON signal of the intermediary transfer belt 31 outputted from the CPU which manages the control of respective parts of the image forming apparatus 1 is effective (S610). In the case where the ON signal is not effective (drive OFF) (NO of S610), zero is stored as a PWM duty ratio D (S710). However, in the case where the ON signal is effective (drive ON) (YES of S610), the first detected speed 133 is detected and then extracts and stores a detected speed value V1 (S620). The passing time of the mark 121 from passing of the A-phase light receiving portion 304A of the first mark detecting sensor 122 to passing of the A-phase light receiving portion 304B of the second mark detecting sensor 123 is detected and then the first detected speed 133 is calculated from this passing time. The calculated value of the first detected speed 133 is extracted from the sensor section detection operation part 131 and is stored.

The controller 210 detects the second detected speed 134 and then extracts and stores the detected speed value V2 (S630). The passing time of the mark 121 from passing of the A-phase light receiving portion 304B of the second mark detecting sensor 123 to passing of the B-phase light receiving portion 305B of the second mark detecting sensor 123 is detected and then the second detected speed 134 is calculated from this passing time. The calculated value of the second detected speed 134 is extracted from the AB-phase section detecting operation part 132 and is stored.

The controller 210 operates a target speed at a subsequent sampling time and then stores a calculated value Vo (S640). Then, the speed value V1 stored in the step S620 is subtracted from the stored speed value Vo and the thus calculated speed deviation Vd1 is stored (S650). Further, the controller 210 subtracts the step value V2 stored in the step S630 from the stored speed value Vo and then stores a calculated speed deviation Vd2 (S660). The controller 210 performs the integral operation of the speed deviation Vd1 stored in the step S650 and stores a calculated deviation integration value Xd (S670). This integral operation is performed by accumulating values each obtained by multiplying the speed deviation Vd1 by the integral parameter and the sampling time.

The controller 210 adds the speed deviation Vd2 stored in the step S660 and the deviation integration value Xd stored in the step S670 and stores a calculated value S (S680). Then, the PI control operation is performed by using the stored value S as an input (S690).

Specifically, a proportional operation value P is calculated by multiplying the value S by a proportion parameter. Then, the value S is subjected to the integral operation to calculate an integral operation value I. This integral operation is performed by accumulating values each obtained by multiplying the value S by an integration parameter and a sampling time. Then, the proportional operation value P and the integral operation value I are added to calculate a control value C.

The controller 210 stores zero as the PWM duty ratio D when the control value C calculated in the step S690 is a negative value, and stores 1 as the PWM duty ratio D when the control value C is a value larger than 1. Then, when the control value C is a value between 0 and 1, the controller 210 stores the control value C as the PWM duty ratio D (S700). Then, the controller 210 generates a pulse signal with the PWM duty ratio D stored in the step S700 or the step S710 (S720). Thereafter, every sampling time of the controller 210, the flow up to the steps 720 is periodically repeated to effect the drive control of the intermediary transfer belt 31.

Embodiment 3

FIG. 11 is a block diagram of intermediary transfer belt drive control in Embodiment 3. In Embodiment 3, another method in which a speed signal from which the detection delay is eliminated by integral operation of the first detected speed will be described. Embodiment 3 is also an example in which the detection delay is suppressed by synthesizing a closed-loop signal by using respective detection signals.

As shown in FIG. 11, a control constitution in this embodiment is the same as that in Embodiment 1 except for an interior constitution of a controller 220. Further, a part of the interior constitution of the controller 220 is also the same as that in Embodiment 1. For this reason, in FIG. 11, constituent elements (parts) which are the same as those in FIG. 3 of Embodiment 1 are represented by the same reference numerals and will be omitted from redundant description.

The controller 220 is provided, as the electric circuit, on the control substrate 90. The controller 210 includes the signal synthesizing operation part 143, the integrating operation part 145, the target speed generator 151, speed deviation operation part 152 the motor command value operation part 153, and a sign inversion operation part 154.

The speed deviation operation part 152 of the controller 220 operates, in order to operate the fluctuation (increase/decrease) of the motor command value from the difference between the current detected speed and the target speed, the deviation between the first detected speed 133 obtained by the sensor section detection and the target speed generated by the target speed generator 151.

The integrating operation part 145 uses the frequency, at which the detection delay influence appears, as a zero cross frequency, and amplitudes the signal component not more than the zero cross frequency and attenuates the signal component not less than the zero cross frequency. The integrating operation part 145 generates, from the above deviation, a deviation integration signal 149 by amplifying the low frequency range signal including the DC component with less detection delay influence and by attenuating a signal in a frequency range, influenced by the detection delay, including the boundary frequency range of the servo band.

As described in Embodiment 2, with respect to the first detected speed 133 having the detection delay of 25 msec, as shown in (a) of FIG. 5, the phase delay remarkably appears with respect to the signal of not less than 1 Hz. Therefore, in the integrating operation part 145, the first detected speed 133 is subjected to integral operation and multiplication ($\times 2.0 \times \pi \times 1$ (Hz)) so that 1 Hz becomes the zero cross frequency. As a result, the deviation integral signal 149 becomes a deviation integration signal 149 which is amplified in the frequency range lower than 1 Hz and is attenuated in the frequency range higher than 1 Hz.

This deviation integration signal 149 is treated as a target value of a closed loop of the second detected speed 134 obtained by the AB-phase section detection. For sign inversion operation part 154 inverts the sign of a signal for the second detected speed 134 obtained by the AB-phase section detection so that the sign (positive/negative) of the difference between the current detected speed and the target speed coincides with the sign of the fluctuation of the motor command value. The signal synthesizing operation part 143 calculates the control operation output signal 155 by synthesizing the sign-inverted signal and the deviation integration signal 149. The second detected speed 134 is multiplied by −1 in the sign inversion operation part 154 and is synthesized with the deviation integration signal 149 in the signal synthesizing operation part 134. The calculated control operation signal 155 is increased in ratio of the first detected speed 133 more than the second detected speed 134 in the frequency range, lower than 1 Hz, including a DC component. Further, in the frequency range, higher than 1 Hz, including the boundary frequency of the servo band, the composite signal 144 is increased in ratio of the second detected speed 134 more than the first detected speed 133. As a result, the control operation input signal 155 with substantially no detection delay is generated.

As shown in FIG. 6, the motor command value operation part 153 performs operations of PI control and upper and lower limiting control to generate a motor driving command signal 156 to be inputted into a motor driver 160. The motor driving command signal 156 is a PWM pulse signal, and the motor driver 160 drives) the motor 36 on the basis of this PWM pulse signal.

In the constitution of Embodiment 3, the integrator is used for the band separation and therefore a gain particularly in a low frequency range becomes large. Therefore, in the low frequency range, the speed control accuracy of the intermediary transfer belt 31 can be improved.

In Embodiment 3, an example in which the signal band separation is made by using the integral operation is shown but the band separation for the first detected speed 133 may also be made by using a control element having a similar function.

Modified Embodiment of Embodiment 3

FIG. 12 is a flow chart of control in Modified Embodiment of Embodiment 1. The electric circuit shown in FIG. 11 includes the micro-computer circuit, a small number of dedicated integrated circuits and a program stored in a non-volatile memory and is provided on the control substrate 90 shown in FIG. 1. Processing for generating the motor drive command signal by the controller 220 is carried out by a CPU of the micro-computer circuit on the basis of the control program stored in the non-volatile memory provided on the control substrate 90.

As shown in FIG. 12 with reference to FIG. 11, the controller 220 discriminates whether or not a drive ON signal of the intermediary transfer belt 31 outputted from the CPU which manages the control of respective parts of the image forming apparatus 1 is effective (S810). In the case where the ON signal is not effective (drive OFF) (NO of S810), zero is stored as a PWM duty ratio D (S910). However, in the case where the ON signal is effective (drive ON) (YES of S810), the first detected speed 133 is detected and then extracts and stores a detected speed value V1 (S820). The passing time of the mark 121 from passing of the A-phase light receiving portion 304A of the first mark detecting sensor 122 to passing of the A-phase light receiving portion 304B of the second mark detecting sensor 123 is detected and then the first detected speed 133 is calculated from this passing time. The calculated value of the first detected speed 133 is extracted from the sensor section detection operation part 131 and is stored.

The controller 220 detects the second detected speed 134 and then extracts and stores the detected speed value V2 (S830). The passing time of the mark 121 from passing of the A-phase light receiving portion 304B of the second mark detecting sensor 123 to passing of the B-phase light receiving portion 305B of the second mark detecting sensor 123 is detected and then the second detected speed 134 is calculated from this passing time. The calculated value of the second detected speed 134 is extracted from the AB-phase section detecting operation part 132 and is stored.

The controller 220 operates a target speed at a subsequent sampling time and then stores a calculated value Vo (S840). Then, the speed value V1 stored in the step S620 is subtracted from the stored speed value Vo to obtain a speed deviation Vd1, which is stored (S850). The controller 220 performs the integral operation of the speed deviation Vd1 stored in the step S850 and stores a calculated deviation integration value Xd (S860). This integral operation is performed by accumulating values each obtained by multiplying the speed deviation Vd1 by the integral parameter and the sampling time.

The controller 200 multiplies the speed value V2 stored in the step S830 by −1 and then stores a calculated value Vm (S870). Then, the controller 220 adds the speed deviation integration value Xd stored in the step S860 and the value Vm stored in the step S870 and stores a calculated value S (S880). Then, the controller 220 performs the PI control operation by using the value S stored in the step S880 as an input (S890). First, a proportional operation value P is calculated by multiplying the value S by a proportion parameter. Then, the value S is subjected to the integral operation to calculate an integral operation value I. This integral operation is performed by accumulating values each obtained by multiplying the value S by an integration parameter and a sampling time. Then, the proportional operation value P and the integral operation value I are added to calculate a control value C.

The controller 220 stores zero as the PWM duty ratio D when the control value C calculated in the step S890 is a negative value, and stores 1 as the PWM duty ratio D when the control value C is a value larger than 1. Then, when the control value C is a value between 0 and 1, the controller 210 stores the control value C as the PWM duty ratio D (S900).

The controller 220 generates a pulse signal with the PWM duty ratio D stored in the step S900 or the step S910 (S920). Thereafter, every sampling time of the controller 220, the flow up to the steps 920 is periodically repeated to effect the drive control of the intermediary transfer belt 31.

Embodiment 4

FIG. 13 is a block diagram of intermediary transfer belt drive control in Embodiment 4. In Embodiments 1 to 3, the method in which the speed calculated by the AB-phase section detection by the second mark detecting sensor 123 was used as the second detected speed 134 was described. In Embodiment 4, a method in which a speed calculated by encoder detection by the second mark detecting sensor 123 is used as the second detected speed 134 will be described. That is, in Embodiments 1 to 3, the second mark detecting sensor had the constitution in which it included the plurality of light receiving portions and detected the belt movement speed from the mark passing time. On the other hand, in this embodiment, such a constitution that a single light receiving portion detects the belt movement speed from the mark passing time in the mark is employed.

As shown in FIG. 14, the control of Embodiment 4 is the same as that in Embodiment 1 except for an encoder detection operation part 135.

As shown in FIGS. 13 and 14, the encoder detection operation part 135 as an example of a second detecting means detects a plurality of marks 121 formed on the intermediary transfer belt 31 by using the A-phase light receiving portion 304B to obtain the second detected speed 134 as an example of second speed information. The A-phase light receiving portion 304B for performing the output to the encoder detection operation part 135 also has the function of performing the output to the sensor section detection operation part 131.

Simultaneously with input of the A-phase signals 124 and 126 of the first and second mark detecting sensors 122 and 123 into the sensor section detection operation part 131, the A-phase signal 126 of the second mark detecting sensor 123 is outputted into the encoder detect ion operation part 135. The encoder detection operation part 135 calculates the second detected speed 134 from the A-phase signal 126 from the A-phase light receiving portion 304B.

The encoder detection operation part 135 detects passing time intervals of the marks 121 with the interval of 84.6 mm successively passing through the A-phase light receiving portion 304B of the second mark detecting sensor 123 as tAA(1), tAA(2), . . . , as shown in FIG. 4.

The encoder detection operation part 135 calculates the second detected speeds 134 by the following equations.

$$V3(1)=84.6(\mu m)/tAA \quad (1)$$

$$V3(2)=84.6(\mu m)/tAA \quad (2)$$

$$V3(3)=84.6(\mu m)/tAA \quad (3)$$

The controller 200 as an example of a control means feed backs the first detected speed 133 and the second detected speed 134, thus controlling the motor 36.

According to the control in Embodiment 4, as the second detected speed 134, a speed obtained by passing the encoder detection value of the second mark detecting sensor 123 through the high-pass filter 142 and therefore the influence of the mark interval error can be made small.

In addition, the detection delay influence of the section detection by the two mark detecting sensors is suppressed and therefore the servo band which is a frequency range of followable speed fluctuation can be increased. As a result, the rotational speed fluctuation of the intermediary transfer belt 31 can be suppressed to reduce a degree of the positional deviation during transfer, so that it is possible to prevent a lowering in image quality.

Further, in Embodiment 4, the second detected speed 134 was detected by using the single second mark detecting sensor 123. However, a plurality of second mark detecting sensors 123 may also be arranged along the rotational direction of the intermediary transfer belt 31 to obtain an average of outputs from the second mark detecting sensors 123, so that an error variation in interval may also be reduced.

Further, in Embodiment 4, the calculating method of the second detected speed 134 by the encoder detection is described based on the time interval of the A-phase signal of the second mark detecting sensor 123 but the second detected speed 134 may also be calculated from the time interval of the B-phase signal of the second mark detecting sensor 123, the time interval of the A-phase signal of the first mark detecting sensor 122, or the time interval of the B-phase signal of the first mark detecting sensor 122.

Further, in Embodiment 4, the control constitution is described based on the controller 200 which is the same as that in Embodiment 1 but the controller 200 may also be replaced with the controller 210 which is the same as that in Embodiment 2 or the controller 220 which is the same as that in Embodiment 3.

Embodiment 5

FIG. 15 is a block diagram of intermediary transfer belt drive control in Embodiment 5. In Embodiments 1 to 3, the method in which the speed calculated by the AB-phase section detection by the second mark detecting sensor 123 was used as the second detected speed 134 was described. In Embodiment 5, a method in which a speed calculated by encoder detection by a rotary encoder 128 is used as the second detected speed 134 will be described.

As shown in FIG. 15, the constitution of Embodiment 5 is the same as those in Embodiments 1 and 4 except for the rotary encoder 128 and an encoder detection operation part 136. For this reason, in FIG. 15, constituent elements (means) identical to those in FIG. 3 are represented by the same reference numerals (symbols) and will be omitted from redundant description.

As shown in FIG. 15, the rotary encoder 128 is mounted on the rotation shaft of the driving roller 32 for rotating the intermediary transfer belt 31. The rotary encoder 128 outputs a pulse signal 129 depending on an angle of rotation of the rotation shaft. The rotary encoder 128 outputs, when the rotation shaft is rotated, e.g., one turn, 600 pulse signals 129.

The rotary encoder 128 may only be required to be mounted on the rotation shaft which rotates in interrelation with the rotation of the intermediary transfer belt 31 and may also be mounted on a shaft of any one of the steering roller 33, the back-up roller 34 and the motor 36 for rotating the driving roller 32.

The rotary encoder detection operation part 136 calculates the second detected speed 134 from the pulse signal 129 from the rotary encoder 128.

The rotary encoder detection operation part 136 successively detects time intervals f pulse edges of the pulse signals 129 as tRe(1), tRE(2), . . . , respectively.

The rotary encoder detection operation part 136 calculates the second detected speed 134, according to equations shown below, based on the number of pulses per one full circumference of the driving roller 32 and a feeding radius of the intermediary transfer belt (the sum of the radius of the driving roller 32 and ½ of the thickness of the intermediary transfer belt 31) of, e.g., 15 mm.

$$V4(1)=2\times\pi\times15(mm)/600/tRE \quad (1)$$

$$V4(2)=2\times\pi\times15(mm)/600/tRE \quad (2)$$

$$V4(3)=2\times\pi\times15(mm)/600/tRE \quad (3)$$

The controller 200 as an example of a control means feed backs the first detected speed 133 and the second detected speed 134, thus controlling the motor 36.

According to the control in Embodiment 5, as the second detected speed 134, a speed obtained by passing the encoder detection value of the rotary encoder 128 through the high-pass filter 142 and therefore the influence of the detection error in a low frequency range of the rotary encoder 128 can be made small.

In addition, the detection delay influence of the section detection by the two mark detecting sensors is suppressed and therefore the servo band which is a frequency range of followable speed fluctuation can be increased. As a result, the rotational speed fluctuation of the intermediary transfer belt 31 can be suppressed to reduce a degree of the positional deviation during transfer, so that it is possible to prevent a lowering in image quality.

In Embodiment 5, the control constitution is described based on the controller 200 which is the same as that in Embodiment 1 but the controller 200 may also be replaced with the controller 210 which is the same as that in Embodiment 2 or the controller 220 which is the same as that in Embodiment 3.

The embodiments of the present invention are described above but the present invention can also be carried out by employing the same constitutions as those in Embodiments 1 to 5 with respect to not only the intermediary transfer belt 31 but also the photosensitive drums 11*a*, 11*b*, 11*c* and 11*d*. Further, in the same constitutions as those in Embodiments 1 to 5, the present invention can also be carried out with respect to speed control of other image bearing members such as a photosensitive belt an intermediary transfer drum, a recording material conveying belt and a recording material conveying drum. As a result, it is possible to realize an image forming apparatus capable of outputting a high quality image by enhancing followability of speed control with respect to a speed fluctuation at a higher frequency without impairing the speed control accuracy with respect to the speed fluctuation at the normal frequency for the recording material conveying belt or the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 093903/2011 filed Apr. 20, 2011, which is hereby incorporated by reference.

What is claimed is:

1. An image forming apparatus comprising:

a rotatable image bearing member including a scale portion, provided through one full circumference along a rotational direction, formed of a plurality of marks continuously provided at a set interval;

a driving member configured to rotationally drive said image bearing member;

a first output portion comprising a first pair of sensors provided at a first interval with respect to a rotational direction of said image bearing member, said first output portion is configured to output a difference in time between when a sensor of said first pair of sensors detects a mark in the scale portion and when another sensor of said first pair of sensors detects the mark in the scale portion, wherein each sensor of said first pair of sensors is configured to detect the mark in the scale portion;

a second output portion comprising a second pair of sensors, which is different from said first pair of sensors, and provided at a second interval, shorter than the first interval, with respect to a rotational direction of said image bearing member, said second output portion is configured to output a difference in time between when a sensor of said second pair of sensors detects the mark in the scale portion and when another sensor of said second pair of sensors detects the mark in the scale portion, wherein each sensor of said second pair of sensors is configured to detect the mark in the scale portion;

a filter portion configured to suppress a high-frequency part of an output of said first output portion and a low-frequency part of an output of said second output portion; and a controller configured to control said driving member so that a speed of said image bearing member is a set speed based on an output of said filter portion.

2. An apparatus according to claim 1, wherein the second interval is smaller than the set interval of the marks.

* * * * *